US009115543B2

(12) United States Patent
Pionetti

(10) Patent No.: US 9,115,543 B2
(45) Date of Patent: Aug. 25, 2015

(54) INSTALLATION COMPRISING SEABED-TO-SURFACE CONNECTIONS OF THE MULTI-RISER HYBRID TOWER TYPE, INCLUDING POSITIVE-BUOYANCY FLEXIBLE PIPES

(71) Applicant: Francois Regis Pionetti, Le Baleine (FR)

(72) Inventor: Francois Regis Pionetti, Le Baleine (FR)

(73) Assignee: Saipem S.A., Montigny Le Bretonneux (FR)

( * ) Notice: Subject to any disclaimer, the term of this patent is extended or adjusted under 35 U.S.C. 154(b) by 0 days.

(21) Appl. No.: 14/386,279

(22) PCT Filed: Mar. 19, 2013

(86) PCT No.: PCT/FR2013/050589

§ 371 (c)(1),
(2) Date: Sep. 18, 2014

(87) PCT Pub. No.: WO2013/140090

PCT Pub. Date: Sep. 26, 2013

(65) Prior Publication Data

US 2015/0047852 A1 Feb. 19, 2015

(30) Foreign Application Priority Data

Mar. 21, 2012 (FR) ..... 12 52542

(51) Int. Cl.

| | |
|---|---|
| ***E21B 17/01*** | (2006.01) |
| ***E21B 19/00*** | (2006.01) |
| ***E21B 17/08*** | (2006.01) |
| ***E21B 17/18*** | (2006.01) |
| ***E21B 17/20*** | (2006.01) |
| ***E21B 43/013*** | (2006.01) |

(52) U.S. Cl.

CPC ..... *E21B 19/002* (2013.01); *E21B 17/012* (2013.01); *E21B 17/085* (2013.01); *E21B 17/18* (2013.01); *E21B 17/20* (2013.01); *E21B 43/013* (2013.01)

(58) Field of Classification Search

CPC ..... E21B 17/012; E21B 17/015
USPC ..... 166/350, 354, 355, 367; 405/224.2–224.4; 441/3–5

See application file for complete search history.

(56) References Cited

U.S. PATENT DOCUMENTS

| | | | | |
|---|---|---|---|---|
| 3,363,683 | A * | 1/1968 | Corley, Jr. et al. | 166/355 |
| 3,708,811 | A * | 1/1973 | Flory | 441/5 |
| 4,391,332 | A * | 7/1983 | Fayren | 166/350 |
| 4,462,717 | A * | 7/1984 | Falcimaigne | 405/224.3 |
| 4,470,722 | A * | 9/1984 | Gregory | 405/224.2 |

(Continued)

FOREIGN PATENT DOCUMENTS

| | | |
|---|---|---|
| FR | 2 790 054 | 8/2000 |
| FR | 2 911 907 | 8/2008 |

(Continued)

*Primary Examiner* — Matthew Buck
(74) *Attorney, Agent, or Firm* — Cozen O'Connor

(57) ABSTRACT

A bottom-to-surface connection installation having a floating support and a turret and having: a plurality of risers having their top ends secured to a carrier structure a plurality of flexible pipes extending from the turret to the top ends of the risers; the flexible pipes including at least two first flexible pipes with positive buoyancy positioned at different heights; and guide modules secured to a tension leg and suitable for sliding along floats of the risers.

15 Claims, 8 Drawing Sheets

(56) References Cited

U.S. PATENT DOCUMENTS

| | | | | |
|---|---|---|---|---|
| 4,848,949 | A * | 7/1989 | Castel | 403/12 |
| 6,082,391 | A * | 7/2000 | Thiebaud et al. | 137/236.1 |
| 6,461,083 | B1 * | 10/2002 | Pionetti et al. | 405/224.2 |
| 6,837,311 | B1 * | 1/2005 | Sele et al. | 166/353 |
| 7,367,398 | B2 * | 5/2008 | Chiesa et al. | 166/302 |
| 8,136,599 | B2 * | 3/2012 | Alliot | 166/350 |
| 8,734,055 | B2 * | 5/2014 | Remery et al. | 405/171 |
| 8,905,143 | B2 * | 12/2014 | Joensen et al. | 166/367 |
| 2007/0003374 | A1 * | 1/2007 | Miorcec de Kerdanet et al. | 405/224 |
| 2008/0302535 | A1 * | 12/2008 | Barnes | 166/339 |
| 2010/0018717 | A1 * | 1/2010 | Espinasse et al. | 166/346 |
| 2011/0083853 | A1 * | 4/2011 | Pionetti | 166/345 |
| 2012/0292040 | A1 * | 11/2012 | Prescott | 166/345 |

FOREIGN PATENT DOCUMENTS

| | | | |
|---|---|---|---|
| FR | 2 930 587 | | 10/2009 |
| FR | 2 942 497 | | 8/2010 |
| WO | WO 00/49267 | | 8/2000 |
| WO | WO 02/076818 | | 10/2002 |
| WO | WO 03070561 | A1 * | 8/2003 |
| WO | WO 2009/122098 | | 10/2009 |
| WO | WO 2009/138609 | | 11/2009 |
| WO | WO 2010/097528 | | 9/2010 |
| WO | WO 2011/144864 | | 11/2011 |

* cited by examiner

INSTALLATION COMPRISING SEABED-TO-SURFACE CONNECTIONS OF THE MULTI-RISER HYBRID TOWER TYPE, INCLUDING POSITIVE-BUOYANCY FLEXIBLE PIPES

PRIORITY CLAIM

This is a U.S. national stage of application No. PCT/FR2013/050589, filed on Mar. 19, 2013. Priority is claimed on French Application No.: FR 1252542 filed Mar. 21, 2012, the content of which is incorporated herein by reference.

FIELD OF THE INVENTION

The present invention relates to an installation of multiple bottom-to-surface connections between undersea pipes resting on the sea bottom and a floating support on the surface, the installation comprising a hybrid tower made up of a plurality of flexible pipes connected to a plurality of rigid riser pipes, or vertical risers, with the bottom end of the hybrid tower secured to an anchor device comprising a base arranged at the sea bottom.

The technical sector of the invention is more particularly the field of fabricating and installing production risers for off-shore extraction of oil, gas, or other soluble or fusible material or a suspension of mineral material from an undersea well head to a floating support, in order to develop production fields located at sea, at a distance from the coast. The main and immediate application of the invention lies in the field of oil production.

BACKGROUND OF THE INVENTION

In general, a floating support has anchor means to enable it to remain in position in spite of the effects of current, wind, and swell. It generally also includes means for storing and processing oil and off-loading means for use with off-loading tankers, where such tankers call at regular intervals to remove the production. Such floating supports are commonly referred to as floating production storage off-loading (FPSO) units.

Floating supports are:

- either of constant heading type, i.e. they possess a plurality of anchors, generally situated at each of the corners of said floating support and serving to keep it on a heading that cannot vary, leaving it free to move only in roll and in pitching and limiting any movement in surge and yaw;
- or else of the turret type, i.e. all of the anchors converge on a cylindrical structure secured to the vessel, but free to rotate about a vertical axis ZZ', thus leaving the floating support free to turn around said turret and position itself in the direction of least resistance for the resultant of the effects of wind, current, and swell on the floating support and its super-structures.

The floating support is thus either anchored at its four corners so that it retains a heading that is substantially constant throughout the lifetime of the installations, or else it is anchored at a single point referred to as a "turret" that is generally situated towards the front of the vessel, generally in the front third, or indeed outside the vessel several meters from the stem of the vessel. The FPSO then swings about its turret and naturally takes up a position in the direction of least resistance relative to the forces created by swell, wind, and current. The bottom-to-surface connections are connected to the internal portion of the turret that is substantially stationary relative to the earth and rotary joints known to the person skilled in the art serve to transfer fluids to the FPSO together with electrical power or electric signals between said bottom-to-surface connections and said FPSO. Thus, for an FPSO on a turret, the FPSO can swing through 360° around the axis of its turret, which itself remains substantially stationary relative to the earth.

When conditions are severe, or indeed extreme as in the North Sea, an advantageous floating support is of the turret type in which all of the bottom-to-surface connections converge on a turret prior to reaching the FPSO proper, via a rotary joint coupling situated on the axis of said turret. In general, the pipes of bottom-to-surface connections are constituted by flexible pipes directly connecting the pipes that rest on the sea bed to the turret, with said flexible pipes generally being organized radially or in a star configuration in a uniform distribution around the axis of said turret. That type of bottom-to-surface connection is more particularly for use in depths in the range 200 meters (m) to 750 m.

The present invention relates more particularly to a bottom-to-surface connection installation between a plurality of undersea pipes resting on the sea bottom and a floating support on the surface comprising a hybrid tower constituted by a plurality of flexible pipes connected to rigid riser pipes, or vertical risers, with the top ends of said flexible pipes being secured to a turret pivoting freely in front of the vessel or within the vessel, generally in the front third of said vessel.

A large variety of bottom-to-surface connections are in existence that enable undersea well heads to be connected to an FPSO type floating support, and in certain oil field developments certain fields, a plurality of well heads are connected in parallel to a common bottom-to-surface connection so as to limit the number of pipes that are connected to the turret of the FPSO, thereby simplifying the design of the turret, which is designed mainly to take up the forces for anchoring the FPSO, which is itself subjected to the effects of swell, wind, and current.

Numerous configurations have been developed, and reference may be made to patent WO 2009/122098 in the name of the Applicant, which describes an FPSO fitted with such a turret and associated flexible pipes, more particularly for use in the extreme conditions that are to be encountered in the Arctic. Such a configuration is advantageous for medium depths of water, i.e. lying in the range 100 meters (m) to 350 m, or indeed in the range 500 m to 600 m. In particular, using flexible pipes over the full depth of the body of water between the rigid pipes resting on the sea bottom and the floating support allows the floating supports to move more than would be possible if rigid pipes were used. Nevertheless, with that type of bottom-to-surface connection between the turret of a floating support and pipes resting on the sea bottom, it is not possible to use said flexible pipes in a dipping catenary configuration, i.e. with a low point of inflection as described for hybrid tower type bottom-to-surface connections that comprise:

- a vertical riser having its bottom end anchored to the sea bottom via a flexible hinge and connected to a said pipe resting on the sea bottom, and having its top end connected to a float immersed in the subsurface and serving to tension the riser; and
- a connecting flexible pipe between the top end of said riser and a floating support on the surface, said connecting flexible pipe possibly taking up under the effect of its own weight the shape of a dipping catenary curve, i.e. a curve that goes down well below the float and subsequently rises up to said floating support, which dipping catenary is capable of accommodating large amounts of movement of the floating support, with this being absorbed by deformation of the flexible pipe, in particular by raising or lowering said low point of inflection of the dipping catenary.

It should be recalled that the essential function of dipping flexible pipes is to absorb at least part of the movements of the top ends of the rigid pipes to which one of their ends is connected and/or the movements of the floating support to which their other end is connected, by mechanically decoupling the respective movements of the top ends of the rigid pipes to which they are connected from the movements of the floating supports to which they are also connected at their other ends.

In known manner, a said flexible connection pipe takes the shape of a dipping catenary curve under the effect of its own weight, i.e. it goes down well below its attachment points at each of its ends, respectively with the floating support and with the top end of the rigid pipe to which it is connected, providing the length of said flexible pipe is longer than the distance between its attachment point to the floating support and the top end of said rigid pipe to which it is connected.

In order to connect the flexible pipes to said rigid pipes or "risers", gooseneck type devices known to the person skilled in the art are interposed between them, with an improved example of such a device being described in FR 2 809 136 in the name of the Applicant.

However, as soon as the water reaches a depth lying in the range 1000 m to 1500 m, or indeed 2000 m to 3000 m, the cost of such a multitude of flexible pipes becomes very high because of the developed length of each of said flexible pipes, since such flexible pipes are very complex and very difficult to fabricate if they are to achieve the levels of safety in operation that are required to enable them to remain in operation over periods of time that may reach or exceed 20 years to 25 years, or even more.

In particular, the flexible pipes run the risk of interfering with one another and striking against one another.

WO 2011/144864 describes a bottom-to-surface connection installation for a floating support having a turret to which the flexible pipes are fastened and secured via a guide structure. That type of bottom-to-surface connection is simultaneously compact, mechanically reliable in terms of being long-lasting, while also being relatively inexpensive and simple to make.

In WO 2011/144864, said guide structure is held in the subsurface between said turret and said carrier structure and it enables a plurality of dipping catenaries to be created that extend (concerning the center of the pipe) in planes that are substantially vertical and that intersect the vertical axis $Z_1Z_1$ of said guide structure, while also enabling said dipping catenaries to be spaced apart laterally from one another in a perpendicular plane that is horizontal.

Furthermore, the guide structure serves to guarantee the curvature of said dipping catenaries at their bottom points of inflection, ensuring that they always have a radius of curvature greater than a minimum radius of curvature beyond which deformation to the flexible pipe will become irreversible and/or damaging.

In all, said guide structure of WO 2011/144864 enables a larger number of flexible pipes to be used in optimized reduced space without those pipes interfering with one another and in particular without them striking one another, in the event of said floating support moving because of swell, current, and/or waves.

Nevertheless, in certain oil field developments, it is necessary to connect each of the well heads individually to said FPSO, which means that there are very many bottom-to-surface connections, thereby requiring the dimensions of the turret and/or of the guide structure as described in WO 2011/144864 to be increased in order to be capable of containing all of the flexible connections without them interfering with one another, and above all enabling the multiple pipe riser columns to be arranged so that any two said riser columns are spaced sufficiently far apart to avoid interfering with each other.

SUMMARY OF THE INVENTION

An object of the present invention is thus to provide an installation capable of having a greater number of bottom-to-surface connections connecting a turret to pipes on the sea bottom in a compact space and under conditions of mechanical reliability and of costs that are also optimized.

In order to install a maximum of bottom-to-surface connections from a common floating support so as to optimize the working of oil fields, various systems have been proposed capable of associating a plurality of vertical risers with one another in order to reduce the size of the field of working and in order to use a larger number of bottom-to-surface connections all connected to the same floating support. Typically, it is necessary to be able to install up to thirty or indeed forty bottom-to-surface connections from a single floating support.

WO 00/49267, in the name of the Applicant, describes a multi-riser hybrid tower including an anchor system with a vertical tension leg constituted either by a cable or by a metal bar or even by a pipe tensioned at its top end by a float. The bottom end of the tension leg is fastened to a base resting on the bottom. Said tension leg includes guide means distributed over its entire length with a plurality of said vertical risers passing therethrough. Said base may merely be placed on the sea bottom and rest in place under its own weight, or it may be anchored by means of piles or any other device suitable for holding it in place. In WO 00/49267, the bottom end of the vertical riser is suitable for being connected to the end of a bent sleeve that is movable relative to said base between a high position and a low position, said sleeve being suspended from the base and being associated with return means that urge it towards a high position in the absence of a riser. This ability of the bent sleeve to move enables variations in riser length under the effects of temperature and pressure to be absorbed. At the head of the vertical riser, an abutment device secured thereto bears against the support guide installed at the head of the float and thus holds the entire riser in suspension.

The connection with the undersea pipe resting on the sea bottom is generally provided via a portion of pipe having a pigtail shape or an S-shape, referred to as a "jumper", said S-shape being made either in a vertical plane or in a horizontal plane, the connection with said undersea pipe generally being made via an automatic connector.

In order to install multi-riser hybrid towers as described in WO 00/49267, the bottom-to-surface connections are generally kept vertical by means of a float of very large dimensions, with buoyancy that may be as great as 500 metric tonnes (t), or indeed 1000 t for the largest of them. Unfortunately, safety regulations require that the vessel weather-cocking around its turret must never find itself above such a large capacity float. This is because, in the event of the connection between said float and said riser column breaking, the sudden and uncontrolled upward movement of such a float would constitute an extremely dangerous projectile for any equipment present in the zone in which it moves upwards. It is therefore necessary to locate the foot of the riser column at a considerable distance away to ensure that said float is always well outside the swinging circle of the vessel. This leads to a considerable increase in the lengths of the flexible pipes connecting the top of the riser column to the turret of the FPSO, thereby considerably increasing its costs, since such high pressure flexible pipes are components that are very expensive. Large-capacity FPSOs have a length lying in the range 300 m to 350 m, so the extra length of the flexible pipe may reach or exceed 500 m or even 750 m for each pipe. Furthermore, by increasing the length of the flexible pipes, the forces generated by the swell and by various currents are increased correspondingly, which forces act on the turret and thus on the anchoring, thereby going against the stability that is desired for the FPSO.

Furthermore, in WO 2009/138609 in the name of the Applicant, a bottom-to-surface connection of the hybrid tower type is described that seeks to facilitate fabrication and installation at sea, without using a head float, the connection being constituted by a rigid riser column embedded at its foot in a foundation and connected to the FPSO by a flexible pipe having buoyancy elements over a terminal portion of its length, the terminal portion of the flexible pipe with positive buoyancy extending in continuity of curvature with said rigid riser column so as to avoid using a head float and also serving to avoid using a gooseneck type connection device between the riser and the flexible pipe. However, that type of hybrid tower described in WO 2009/138609 and suitable for being fabricated and installed in simplified manner, constitutes only one bottom-to-surface connection and it is not suitable for use in a multi-riser hybrid tower having a plurality of risers around a tension leg anchored at its foot.

Documents WO 2010/097528 and WO 2011/144864 describe multi-riser hybrid towers having sliding buoyancy and guidance modules, comprising:

a) a vertical tension leg secured at its top end to a carrier structure suitable for being suspended from a top float, that is immersed in the subsurface, suspension being via a chain or cable, said tension leg being secured at its bottom end to a bottom guide structure and being suitable for being fastened to a base member resting on the sea bed or to a foundation embedded in the sea bottom, the bottom end connection preferably being via a flexible joint;

b) a plurality of rigid vertical pipes known as risers, having their top ends secured to said carrier structure, the bottom end of each said rigid pipe or riser being suitable for being connected to an undersea pipe resting on the sea bottom;

c) a plurality of guide means for guiding said risers, said guide means and said bottom guide structure being suitable for maintaining said risers arranged around said tension leg; and d) buoyancy elements co-operating with said tension leg, the buoyancy elements being distributed along said tension leg, and preferably being constituted by buoyancy elements that withstand undersea hydrostatic pressure, and more preferably being syntactic foam buoyancy elements;

said tower being characterized in that it comprises a plurality of buoyancy and guide modules constituting a plurality of independent structures suitable for sliding along said tension leg and along said risers, said structure supporting said buoyancy elements and guiding said risers in positions around said tension leg that are preferably regularly and symmetrically distributed.

Said modules and thus said buoyancy elements slide along the tension leg beneath said carrier structure and they are held at the top ends of said risers and of said tension leg by said carrier structure. The tension created by the sum of the buoyancies of the various modules is thus transferred to the top of the tension leg via said carrier structure against which the top buoyancy modules comes into abutment, with the other modules pressing up against the underfaces of the others.

Thus, in that embodiment, the fact that the buoyancy modules slide along the risers and the tension leg ensures that all of the tension is delivered to the top carrier structure to which the top ends of the risers are fastened, and the structure of the modules and also the connections between the risers and the top carrier structure must take up considerable traction forces representing the full weight of the risers. Specifically, if the foundation is subjected only to the resultant force $T_R$ acting on the head float, i.e. 10% to 50% of the total weight of the tower, the total weight of the tower is taken up by all of the buoyancy modules, which exert upward vertical thrust directly against the underface of said carrier structure. More particularly, the buoyancy modules together provide total buoyancy $\Sigma F$ representing a traction force of magnitude greater than the total weight of the tower Pt, preferably lying in the range 102% to 110% of the total weight of the tower.

Furthermore, since the crude oil is conveyed over very long distances, of several kilometers, it is necessary to provide extreme levels of insulation that are very expensive in order firstly to minimize any increase in viscosity that would reduce the hourly production rate of the wells, and secondly to avoid the stream becoming blocked by deposits of paraffin or by gas hydrates forming whenever the temperature drops to around 30° C. to 40° C. These phenomena are particularly critical when the crude oils are of the paraffin type, as happens in particular in West Africa, given that the temperature at the bottom of the sea is about 4° C. and that the crude oils are of the paraffin type. It is thus desirable for the bottom-to-surface connections to be short in length and for the size of the various connections connected to a common floating support to be limited, for this additional reason of thermal insulation.

In WO 2010/097528 and WO 2011/144864, the buoyancy elements are slidable and they cover only a fraction of the total length of the risers, so they cannot provide optimized thermal insulation.

An object of the present invention is thus to provide a new type of installation for a large quantity of multiple bottom-to-surface connections of a variety of types in association with an FPSO anchored on a turret, enabling a plurality of well heads and undersea installations installed on the sea bottom at great depth, i.e. in depths of water greater than 1000 m, to be connected and preferably to be connected individually, without including any dangerous buoyancy element such as a tensioning float of large dimensions that may be as great as 500 cubic meters ($m^3$) to 1000 $m^3$, or even more, and while also overcoming the drawbacks of prior embodiments, in particular embodiments such as those described in WO 2010/097528 and WO 2011/144864.

It is thus desired to provide an installation usable for enabling a common floating support to be used for operating a plurality of bottom-to-surface connections of the hybrid tower type, which installation is compact, moves little, and is also simpler to install. Still more particularly, another problem posed in the present invention is thus to provide an installation with multiple bottom-to-surface connections from a common floating support for which the method of laying the installation and putting it into place make it possible simultaneously:

to reduce the installation distance between the various bottom-to-surface connections, i.e. to enable a plurality of bottom-to-surface connections to be installed in a space that is as small as possible, or in other words with a reduced "footprint", for the purpose, amongst other things, of increasing the number of bottom-to-surface connections that can be installed via the turret of an FPSO, but without said bottom-to-surface connections interfering with one another;

to fabricate the installation and to install it easily by performing fabrication on land and then towing the installation to its destination site and installing it permanently after up-ending it; and to optimize installation of riser columns, possibly columns fitted with a variety of flexible connections, the assembly remaining ready for future installation of the FPSO anchored to its turret.

Specifically, during the stage of planning the development of an oil field, the oil deposit is known in incomplete manner only, and full rate production then often makes it necessary, after a few years, to reconsider the initial production schemes and to organize associated equipment. Thus, during initial installation of the system, the number of bottom-to-surface connections and the way they are organized is defined relative to estimated needs, which needs are nearly always revised upwards after the field has been put into production, either for the purpose of recovering crude oil, or else because of the need to inject more water into the deposit, or indeed to recover or to reinject more gas. As the deposit is depleted, it is generally necessary to drill new wells in order to reinject water or gas, or indeed to drill production wells at new locations in the field in order to increase the overall recovery ratio, thereby correspondingly complicating all of the bottom-to-surface connections connected to the turret of the FPSO.

Another problem posed in the present invention is to be able to make and install such bottom-to-surface connections for undersea pipes in great depth, going beyond 1000 meters, for example, and of the type comprising a vertical hybrid tower conveying a fluid that needs to be maintained at a temperature above a minimum temperature until it reaches the surface, by minimizing components that are subjected to heat losses, by avoiding the drawbacks created by the various components of said tower being subjected to differential thermal expansion, so as to withstand extreme stresses and the fatigue phenomena that accumulate over the lifetime of the structure, which commonly exceeds 20 years.

Another problem of the present invention is also to provide an installation of multiple bottom-to-surface connections using hybrid towers in which the anchor system is very strong and of low cost, and for which the methods of fabricating and installing the various component elements are simplified and also of low cost, and capable of being performed at sea using ordinary installation vessels.

To do this, the present invention provides a bottom-to-surface connection installation between a plurality of undersea pipes resting on the sea bottom and a floating support at the surface and anchored to the bottom of the sea, the installation comprising:

a said floating support including a turret; and at least one hybrid type tower comprising:

a) a multi-riser tower comprising:

a.1) a vertical tension leg secured at its top end to a top carrier structure, said tension leg being fastened at its bottom end to a base resting on the sea bottom or to an anchor, preferably of the suction anchor type, pressed into the sea bottom;

a.2) a plurality of vertical rigid pipes referred to as "risers", the top end of each riser being secured to said carrier structure, the bottom end of each said riser being connected to or suitable for being connected to an undersea pipe resting on the sea bottom; and a.3) a plurality of guide means suitable for maintaining said risers arranged around a said tension leg at a distance that is substantially constant, and preferably regularly and symmetrically distributed around said tension leg; and b) a plurality of flexible pipes extending from said turret to the respective top ends of a plurality of rigid pipes, with at least one flexible pipe, referred to below as a "first" flexible pipe, having a terminal portion of the flexible pipe adjacent to its junction with the top end of said riser that is fitted with floats referred to as "first" floats imparting positive buoyancy thereto, and at least a top portion of said vertical riser is fitted with floats referred to as "second" floats imparting positive buoyancy thereto, such that the positive buoyancies of said terminal portion of the first flexible pipe and of the top portion of said vertical riser serve to enable said risers to be tensioned in a substantially vertical position and enable the end of said first terminal portion with positive buoyancy of said first flexible pipe to be in alignment with or in continuity of curvature with the top portion of said vertical riser where they are connected together;

said installation being characterized in that at least one said hybrid tower comprises:

at least two said first flexible pipes with positive buoyancy having their ends fastened respectively to two top ends of two said risers, the two top ends of the two risers extending above said top carrier structure at different heights in such a manner that said first flexible pipes are positioned at different heights relative to one another;

said risers fitted with peripheral coaxial second floats surrounding said risers and secured to said risers, said coaxial second floats being distributed, preferably continuously, over at least a top portion of at least 25% of the length of said risers beneath and starting from said top carrier structure, preferably over the length of at least 50% of the length of said risers, more preferably over at least 75% of their length, said coaxial second floats together compensating at least the total weight of said risers;

said guide modules secured to said tension leg and suitable for sliding along said second float of said risers, said guide modules being spaced apart and distributed, preferably regularly, over at least a top portion of at least 25% of the length of said tension leg beneath and starting from said top carrier structure, preferably over the length of at least 50% of the length of said tension leg, more preferably over at least 75% of its length; and said tension leg and said top carrier structure not being suspended to a float immersed in the subsurface, and said tension leg being situated at a distance from the vertical axis (ZZ) of the turret that is less than the distance of the furthest-away end of said floating support from said axis of the turret.

Said guide means are advantageously installed over the entire height of the tower and thus have the essential function of keeping the risers positioned relative to one another and to the tension legs in a configuration that is constant, thereby preventing said risers buckling when they are put into compression, in particular when they are full of gas, the spacing between two successive guide means preferably being made smaller in this zone that might be subject to lateral buckling.

By arranging said flexible pipes with positive buoyancy in respective positions relative to one another, it is possible on each multi-riser hybrid tower to make use of a plurality of positive buoyancy flexible pipes, and in particular two to eight positive buoyancy flexible pipes that are at different heights, even though they are close together in terms of lateral spacing, since all of them converge on the same tower, i.e. to the proximity of the same tension leg.

Because of the plurality of positive buoyancy flexible pipes in combination with the positive buoyancy that is distributed over a said top portion of the length of said risers and of the length of said tension leg starting from said top carrier structure, there is no longer any need to use a head float for the tower in order to put the tower under tension. It is thus possible to bring hybrid towers closer together within the swinging zone of the vessel and without any risk of accident, as explained above. It is thus possible to reduce the problems associated with long flexible pipes, thereby reducing fabrication and thermal insulation costs.

The fact that said coaxial second floats compensate at least the total weight of said risers, and more particularly that each of said second floats associated with a given riser compensates at least the total weight of said riser, thus imparting positive buoyancy to said riser(s) even when said riser(s) is/are full of sea water and the fact that buoyancy elements of the tower do not slide along said risers and said tension leg, mean that the installation of the invention presents the following advantages:

- each of said risers is independent of its neighbors, so the forces generated by the buoyancy of any one riser apply only to the top carrier structure, and then to the tension leg, and then to the foundation; and
- it is possible to combine thermal installation and buoyancy by using buoyancy elements made of a material that combines buoyancy properties with thermal insulation properties, in particular as described in FR 11/52574 in the name of the Applicant and as explained below.

Another advantage of an installation of the invention is that it is possible to use a plurality of hybrid towers with flexible pipes connected to a common turret, but with the towers offset angularly and radially, so as to be arranged in a fan around said turret at distances from said turret that may be identical or different, with it being possible for some of the towers to be installed in part only, such that they do not yet have flexible pipes or such that they have only a fraction of said rigid pipes suitable for being extended by said flexible pipes at their top ends and/or connected to said undersea pipes resting on the sea bottom at their bottom ends, said rigid pipes being ready for connection to well heads and to the floating support, as explained below.

The term "first flexible pipe" is used herein to mean pipes, sometimes also known as "hoses", that are well known to the person in the art and that are described in standards documents published by the American Petroleum Institute (API), more particularly under the references API 17J and API RP 17 B. Such flexible pipes are manufactured and sold in particular by the supplier Technip France under the trade name Coflexip. These flexible pipes generally comprise internal sealing layers made of thermoplastic materials associated with layers suitable for withstanding internal pressure in the pipes, generally made of steel or of composite materials and used in the form of spiral-wound strips that touch one another inside the thermoplastic pipes in order to withstand internal bursting pressure, and associated with external reinforcement over the thermoplastic tubular layer and likewise in the form of touching spiral-wound strips, but using a pitch that is longer, i.e. using a smaller helix angle, particularly one lying in the range 15° to 55°.

The term "vertical" means that when the sea is calm with the installation is at rest, and with the flexible pipes for making connections with the FPSO not yet installed, the tension leg and the risers are arranged substantially vertically, it being understood that swell, and movements of the floating support and/or of the flexible pipes can lead to the tower swinging through an angle at the top that is preferably limited to the range 10° to 15°, in particular because a junction and inertia-transition part is used or a flexible hinge of the Roto-Latch® type at the foot of the tension leg, where it is fastened to said base or anchor.

The term "tower" or "vertical riser" is used herein to mention the substantially vertical theoretical position of said risers when they are at rest, it being understood that the axes of the risers may be subjected to angular movements relative to the vertical and may move in a cone of angle $\gamma$ with its vertex corresponding to the point where the bottom end of the tension leg is fastened to said base. The top end of a said vertical riser may also be slightly curved. Thus, the term "terminal portion of the first flexible pipe substantially in alignment with the axis $Z_1Z_1$ of said riser" is used to mean that the end of the upside-down catenary curve of said first flexible pipe is substantially tangential to the end of said vertical riser. In any event, it is in continuity of curvature variation, i.e. there is no point that is singular in the mathematical sense.

The term "continuity of curvature" between the top end of the vertical riser and the portion of the first flexible pipe that presents positive buoyancy is used to mean that said variation in curvature does not present any singular point such as a sudden change in the angle of inclination of its tangent or a point of inflection.

The slope of the curve formed by the first flexible pipe is preferably such that the angle of inclination of its tangent relative to the axis $Z_1Z_1$ of the top portion of said vertical riser increases continuously and progressively from the point of connection between the top end of the vertical riser and the end of said terminal portion of the first flexible pipe with positive buoyancy, to the point of inflection corresponding to the reversal of curvature between said convex terminal portion and the concave first portion of the first flexible pipe.

The installation of the present invention thus makes it possible to avoid tensioning the vertical riser by means of a float on the surface or in the subsurface, with the top end of the riser being suspended therefrom. This type of installation provides increased stability in terms of angular variation ($\gamma$) in the angle of excursion of the top end of the vertical riser compared with a theoretical rest position that is vertical, since this angular variation is reduced in practice to a maximum angle that does not exceed 5°, and in practice lies in the range about 1° to 4° in the installation of the invention, whereas in embodiments of the prior art, the angular excursion can reach 5° to 10°, or even more.

Another advantage of the present invention lies in that because of this small angular variation of the top end of the vertical riser, it is possible at its bottom end to make use of its foot being rigidly embedded in a second or $n^{th}$ base resting on the sea bottom without having recourse to an inertia-transition part of size that is too great, which would therefore be too expensive. It is also possible to avoid using a flexible hinge, in particular of the flexible ball-joint type, providing the junction between the bottom end of the second or $n^{th}$ riser and said embedded end includes an inertia-transition part.

Likewise, and in known manner, it can be understood that said top carrier structure serves to keep the top ends of said risers and of said vertical tension leg in an unvarying geometrical configuration ensuring that they are fixed to one another at a constant distance.

In known manner, said turret includes a cavity within a structure that is offset in front of the floating support or that is incorporated in or under the hull of the floating support, said cavity preferably passing through the full height of the hull of the floating support.

Also in known manner, said vertical tension leg is constituted by a cable or by a rigid bar, in particular made of metal, or indeed by a pipe.

In known manner, said terminal portion of the first flexible pipe extends over a fraction only of the total length of the first flexible pipe such that said first flexible pipe presents an S-shaped configuration, with a first portion of the first flexible pipe beside said floating support presenting concave curvature in the form of a dipping catenary, and said remaining terminal portion of said first flexible pipe presenting convex curvature in the from of an upside-down catenary because of its positive buoyancy. The term "concave curvature" is used herein to mean that said first portion of the first flexible pipe has curvature with its concave side facing upwards, and the term "convex curvature" is used to mean that said terminal portion of the first flexible pipe has curvature with its convex side facing upwards or its concave side facing downwards.

It can be understood that said first and second flexible pipes positioned at different heights means that two points respectively of an upper first one of the first flexible pipes and of a lower second one of the first flexible pipes situated in a common vertical direction are always situated one above the other, even though a point of the upper flexible pipe may be lower than a point of the lower flexible pipe, providing the two points of the upper and lower first flexible pipes are not in vertical alignment.

It can also be understood that said two first flexible pipes are necessarily slightly offset, since their ends are connected firstly to the top ends of said risers which are laterally offset on said top carrier structure, and since their attachment points to the turret are likewise slightly offset laterally at the turret. In general, the offset in height is greater than the lateral offset between the two first flexible pipes.

In practice, and depending on the diameters of the flexible pipes with positive buoyancy, the minimum height offset of the top ends of said risers to said first flexible pipes are fastened, and thus the minimum distance in height between two of said first flexible pipes arranged at different heights is at least 3 m, and preferably lies in the range 5 m to 10 m.

More particularly, a said tower has two to seven rigid pipes and two to five said first flexible pipes.

In known manner, said turret has a cylindrical internal portion suitable for remaining substantially stationary relative to the sea bottom of the sea inside said cavity when said floating support is caused to swing around the vertical axis (ZZ) of said internal portion or said cavity of the turret, said floating support being anchored to the bottom of the sea by lines that are fastened at their top ends to said cylindrical inner portion of the turret.

In known manner, the bottom ends of the risers are fastened to the ends of undersea pipes lying on the sea bottom, preferably via automatic connectors between said bottom ends of the risers and the ends of the undersea pipes, and/or via sleeves with bends and/or junction pipes with bends.

More particularly, an installation of the invention includes second flexible pipes of smaller diameter or smaller linear weight than said first flexible pipes, said second flexible pipes not having buoyancy elements and being connected to the top ends of said risers via connection devices, preferably of the gooseneck type, said second flexible pipes being situated beneath said first flexible pipes.

Advantageously, buoyancy elements may be secured to said connection part and/or to the underface of said top carrier structure in order to compensate for the weight of said second flexible pipes and of various accessories such as goosenecks, the structural reinforcing elements, and also automatic connectors.

An installation of the invention may also include other "undersea flexible lines" such as a cable, an umbilical, or a pipe capable of accepting large amounts of deformation without generating significant return forces, in particular a flexible pipe. In particular, a control umbilical will include one or more hydraulic pipes and/or electric cables for transmitting energy and/or information.

More particularly, said tension leg is fastened at its bottom end to a base or anchor via an inertia-transition junction part of inertia varying in such a manner that its inertia increases progressively from its top end to the bottom end of said junction part serving to embed the bottom end of said tension leg in said base or anchor.

The term "inertia" is used herein to mean the second moment of area of said junction and inertia-transition part about an axis perpendicular to the axis of said junction and inertia-transition part, which represents the stiffness in bending of said junction and inertia-transition part in each of the planes perpendicular to the vertical axis of symmetry, this second moment of area being proportional to the product of the section of the material multiplied by the square of its distance from said axis of said junction and inertia-transition part.

In known manner, said junction and inertia-transition part presents a cylindrical-conical shape, and said junction part is fastened at its base to a first tubular pile passing through a cylindrical cavity in said base or anchor so as to enable said junction part to be embedded in said base or anchor.

More particularly, an installation of the invention includes third floats secured to said tension leg at least in the spaces between said guide modules, said third floats providing positive buoyancy compensating at least for the weight of said tension leg.

More particularly, said guide modules constitute a plurality of independent rigid structures that are spaced apart by at least 5 m along at least the top portion of said tension leg, each said rigid structure having a plurality of riser-guiding tubular elements defining tubular orifices in which said risers, together with their second floats, can slide, and a central element connected to the tension leg and preferably defining a central orifice through which said tension leg passes and is secured thereto, in particular by welding.

Still more particularly, said guide modules and said second floats extend over at least 50% of the length of the tower between said carrier structure at the top and the bottom end of the tension leg.

More particularly, said guide modules are spaced apart by a distance in the range 2 m to 20 m, preferably in the range 5 m to 15 m, and are at least twenty in number, there being preferably at least fifty guide modules for a tower having a height of at least 1000 m.

More particularly, said first floats together provide accumulated buoyancy representing an upwardly-directed traction force of magnitude greater than the total weight of said risers, preferably than the total weight of the tower, and representing preferably 102% to 115%, more preferably 103% to 106% of the total weight of said risers, and more preferably of the total weight of the tower.

Thus, the vertically upward resultant tension at said top carrier structure lies in the range 2% to 15% of the total weight of the tower, and preferably in the range 3% to 6% of the total weight of the tower.

Thus, said multi-riser tower is tensioned by said float and said support is anchored so that the angle $\gamma$ between the axis ($Z_1Z_1$) of said tension leg and the vertical remains less than 10° when the floating support is moved by rough sea and/or the force of the wind in spite of being anchored.

Preferably, said coaxial second floats are distributed continuously over the entire length of said risers beneath and starting from said top carrier structure, and said guide modules are distributed over the entire length of said tension leg beneath and starting from said top carrier structure.

The positive buoyancies of the riser of the first flexible pipes and of the tension leg may be provided in known manner by peripheral floats surrounding said pipes coaxially, or preferably, for the rigid pipe or vertical riser, a coating of positive buoyancy material, preferably also constituting a lagging material, such as syntactic foam, in the form of a shell sleeve in which said pipe is wrapped. Such buoyancy elements that are capable of withstanding very high pressures, i.e. pressures of about 10 megapascals (MPa) per 1000 m of depth of water, are known to the person skilled in the art and are available from the supplier Balmoral (UK).

Advantageously, the buoyancy and insulation material is constituted by a gum of microspheres having compressibility that is less than that of sea water, as described in the Applicants' patent application FR 11/52574, and as described below.

Also preferably, said first, second, and third floats are in the form of tubular sleeves, preferably in the form of pairs of half-shells forming a tubular sleeve, made of a material that withstands undersea hydrostatic pressure, and at least said second floats, and preferably both said first floats and said second floats are made of a material that also presents thermal insulation properties.

More particularly, a rigid thermal insulation and buoyancy material is constituted by a mixture of:

a) a matrix comprising a uniform mixture of cured elastomer polymer and a liquid insulating plasticizing compound, said insulating plasticizing compound being selected from compounds derived from mineral oils, preferably hydrocarbons, and compounds derived from vegetable oils, preferably vegetable oil esters, said insulating plasticizing compound being a material of the type that does not change phase at a temperature in the range −10° C. to +150° C., the proportion by weight of said insulating plasticizing compound in said matrix being at least 50% and preferably at least 60%; and b) hollow beads, preferably glass microbeads, dispersed within a matrix of said uniform mixture of said polymer and said insulating plasticizing compound, in a proportion by volume constituting at least 35% of the total volume of the mixture of said beads with said matrix, and preferably lying in the range 40% to 65% of the total volume.

Such a material presents thermal insulating properties, buoyancy properties and resistance to cracking that are increased, associated with cost that is less than that of a syntactic foam material made using the same components but without a plasticizing compound, as explained below.

Hollow microbeads are added to an insulating gel of the type described in WO 02/34809. This mixture of an insulating gel and of hollow microbeads presents an advantage in that its buoyancy does not decrease, and indeed even increases with depth, whereas in contrast the buoyancy of a syntactic foam material (similar material but without the plasticizing compound) decreases very significantly with increasing depth of water. This increasing buoyancy as a function of depth stems from the fact that the compressibility modulus of said rigid insulating material of the invention is greater than the compressibility modulus of water, namely greater than 2200 MPa, where the compressibility modulus of water is around 2000 MPa. In other words, the increase in the buoyancy of said material results from the fact that the density of water increases more than does the density of said material as a function of the depth at which the material is to be found.

Consequently, the rigid insulating material of the invention known as glass bubble gum (GBG) provides much better performance in terms of buoyancy at great depth, in particular at depths in the range 1000 m to 3500 m and beyond, than does a syntactic foam of the prior art (a similar material without a plasticizing compound), for which the compressibility modulus does not exceed 1600 MPa.

Furthermore, in this material, the microbeads break at a compression level and thus at a depth in water that is 15% to 30% greater than in a conventional syntactic foam.

Overall, the material of the present invention provides better properties in terms of ability to withstand cracking and in terms of increased buoyancy at great depth, associated with lower cost than a comparable syntactic foam material (using similar ingredients but without the plasticizer compound).

Herein, the term "thermal insulation" is used to mean a material having thermal conductivity properties of less than 0.25 watts per meter per kelvin (W/m/K) and the term "positive buoyancy" means specific gravity of less than 1 relative to sea water.

The term "rigid material" is used herein to mean a material that keeps it shape on its own and that does not deform significantly as a result of its own weight when performed by molding or when confined in a flexible jacket, and in which Young's modulus $\lambda$ is greater than 200 MPa, unlike a gel, which remains extremely flexible and which has a Young's modulus that is practically zero.

The term "mineral oil" is used herein to mean a hydrocarbon oil derived from fossil material, in particular by distilling crude oil, coal, and certain bituminous schists, and the term "vegetable oil" is used to designate an oil derived from plants by extraction, in particular rapeseed oils, sunflower oils, or soybean oils, and more particularly by treatment of the esters of such vegetable oils.

In known manner, the hollow beads are filled with a gas and they withstand the hydrostatic external pressure under the sea. They have a diameter lying in the range 10 micrometers (μm) to 10 mm with microbeads having a diameter lying in the range 10 μm to 150 μm, and preferably in the range 20 μm to 50 μm, with a wall thickness of 1 μm to 2 μm, and preferably of about 1.5 μm. Such glass microspheres are available from the supplier 3M (France).

More particularly, in order to make an insulating buoyancy material that withstands 2500 m, i.e. about 25 MPa, it is advantageous to use a selection of microbeads with a Gaussian distribution centered on 20 μm, whereas for a depth of 1250 m, a Gaussian distribution centered around 40 μm is suitable.

The phase stability of the plasticizing compound of the invention for temperature values lying in the range −10° C. to +150° C. makes it compatible with the temperature values of production oil fluids and of sea water at great depths.

A rigid insulating material of this type, although relatively "rigid" in the meaning of the present invention, presents mechanical behavior in terms of compressibility that is close to that of an elastomer gum because of the small value of its Young's modulus, whereas a syntactic foam behaves like a solid. In the meaning of the present invention, the "rigidity" of the insulating material results essentially from the high content by weight of said microbeads, said microbeads also providing increased buoyancy and thermal insulation compared with an insulating gel having the same composition.

More particularly, an insulating rigid buoyancy material presents specific gravity of less than 0.7, preferably less than 0.6, and thermal conductivity of said material of less than 0.15 watts per meter per kelvin (W/m/K), preferably less than 0.13 W/m/K, and a Young's modulus or three-axis compression modulus of said material lying in the range 100 MPa to 1000 MPa, preferably in the range 200 MPa to 500 MPa, and a compressibility modulus of said rigid insulating material greater than 2000 MPa, preferably greater than 2200 MPa, i.e. a compressibility modulus that is greater than that of water.

More particularly, said plasticizing compound presents a compressibility modulus greater than that of said polymer, preferably greater than 2000 MPa, thermal conductivity and also specific gravity that are less than that of said polymer, preferably thermal conductivity of less than 0.12 W/m/K and specific gravity less than 0.85, and more preferably lying in the range 0.60 to 0.82.

More particularly, an insulating material of this GBG type presents the following characteristics:

- the ratio by weight of said cured polymer to said insulating plasticizing compound lies in the range 15/85 to 40/60, and preferably in the range 20/80 to 30/70; and
- the ratio by volume of said microbeads relative to the volume of said matrix of cured polymer and of said insulating compound lies in the range 35/65 to 65/35, preferably in the range 40/60 to 60/40, more preferably in the range 45/55 to 57/43.

Beyond 85% of plasticizing compound in the matrix, it runs the risk of being sweated out from the matrix.

Also advantageously, said polymer presents a glass transition temperature of less than −10° C., its phase stability thus being compatible with the temperature values of sea water and of production oil fluids at great depths.

More particularly, these properties of compressibility and the comparative properties of thermal insulation and of specific gravity of said plasticizing compound and of said polymer are obtained when, in accordance with a preferred embodiment, said cured polymer is of the polyurethane type and said liquid plasticizing compound is a petroleum product, known as a "light" cut of the fuel type.

Still more particularly, said plasticizer compound is selected from kerosene, gasoil, gasoline, and white spirit.

These fuels, with the exception of gasolines, also present the advantage of having a flashpoint that is higher than 90° C., thereby avoiding any risk of fire or explosion in the manufacturing process.

Kerosene presents thermal conductivity of about 0.11 W/m/K.

In another embodiment, a plasticizer compound is used that is derived from vegetable oil of the biofuel type, preferably an ester of an oil of vegetable origin, in particular an alcohol ester of a vegetable oil, of rapeseed, of sunflower, or of soybean.

More particularly, said polymer is a polyurethane that results from cross-linking polyol and polyisocyanate, said polyol preferably being of the branched type, still more preferably of the type comprising at least a three-branch star, with the polyisocyanate being an isocyanate pre-polymer and/or a polyisocyanate polymer.

Still more particularly, said polyurethane polymer is the result of polyaddition cross-linking of hydroxylated polydiene, preferably hydroxylated polybutadiene, and of aromatic polyisocyanate, preferably 4,4'-diphenyl-methane-diisocyanate (MDI) or a polymeric MDI.

Preferably, the NCO/OH molar ratio of the polyol component and of the polyisocyanate component lies in the range 0.5 to 2, and is preferably greater than 1, still more preferably lies in the range 1 to 1.2. Excess NCO guarantees that all of the OH reacts and that curing is complete, or at least optimized.

Advantageously, said material is confined in a protective jacket.

The outer jacket may be made of metal, such as iron, steel, copper, aluminum, or of metal alloys, or it may equally well be made of a synthetic polymer material such as polpropylene, polyethylene, polyvinylchloride (PVC), polyurethane, or any other polymer can be transformed into tubes, plates, or jackets, or that can be obtained by rotomolding thermoplastic powders, or indeed it may be made of composite material. The above-mentioned option of jackets made of polymer materials is particularly practical and effective since the invention, by making it possible to obtain the rigid insulating buoyancy material of the invention, thus makes it possible to use jacket materials that are less rigid, lighter in weight, and less difficult to work, and consequently generally less expensive. Preferably, the outer jacket is a more or less rigid thick layer having a thickness lying in the range a few millimeters to several centimeters, but it could also be in the form of a film that is flexible or semirigid.

More particularly, said rigid insulating buoyancy material is in the form of a pre-molded part, preferably suitable for being applied around an undersea pipe or an undersea pipe element in order to provide thermal insulation and/or buoyancy while also resisting undersea hydrostatic pressure, preferably at great depths of at least 1000 m.

More particularly, said positive buoyancy of said first floats and of said first flexible pipes is distributed regularly and uniformly over the entire length of said terminal portion of said first flexible pipe, and the buoyancy of said second floats that are distributed over at least said top portion of the rigid pipes and preferably over the entire length of said rigid pipes provides a resulting vertical thrust of 50 kg/m to 150 kg/m over the entire length of said rigid pipes, and/or said first floats of the first flexible pipes provide positive buoyancy over a length corresponding to 30% to 60% of the total length of said first flexible pipes, and preferably about half the total length.

Also preferably, said tower includes a cylindrical outer covering of circular horizontal section made of a plastics or composite material forming a hydrodynamic rigid protective screen surrounding all of said rigid pipes and at least over a top portion of the tower. This screen also contributes to thermally insulating said rigid pipe.

More particularly, said outer covering may be made of metal such as iron, steel, copper, aluminum, and metal alloys, and it can also be made of a synthetic polymer material, such as polypropylene, polyethylene, polyvinylchloride (PVC), polyamides, polyurethanes.

More preferably, an installation of the invention has a plurality of said multi-riser hybrid towers, preferably at least five towers, with their flexible pipes connected or suitable for being connected to a common turret but extending in directions (YY') that are angularly offset so that said towers are arranged in a fan around said turret at distances from said turret that are identical or different, some of said towers possibly being installed in part only and not yet including flexible pipes and/or including only some of said rigid pipes capable of being extended by said flexible pipes at their top ends and/or at least some of said rigid pipes not yet being connected to said undersea pipes resting on the sea bottom at their bottom ends.

It can be understood that said angularly offset directions (YY') are horizontal directions between the vertical axis of the turret and the vertical axis of the tension leg.

Said rigid pipes are thus ready to be connected subsequently to well heads and to the floating support.

The vertical tension leg may also be connected at its bottom end to a base or anchor via a flexible hinge of the laminated abutment type sold by the supplier Techlam France or of the Rotor-Latch® type available from Oilstates USA, and known to the person skilled in the art.

This embodiment having a multiplicity of risers held by a central structure having guide means is advantageous when it is possible to prefabricate the entire tower on land before towing it out to sea, and then once on site, to up-end it in order to put it finally into place as explained below.

The present invention also provides a method of towing a said multi-riser tower at sea and of installing an installation of the invention, which method comprises the following successive steps:

1) prefabricating on land a said tower connected at its head to said flexible pipes with positive buoyancy and having their free ends connected to respective fourth floats;

2) towing said tower at sea in a horizontal position by a laying vessel, said tower floating on the surface because of its said second floats;

3) installing a deadman to the bottom end of said tower;

4) upsetting said tower with its bottom end connected to said base and said fourth floats connected to the free ends of said flexible pipes with positive buoyancy being immersed in the subsurface and offset laterally from the axis $Z_1Z_1$ of said tower in such a manner that said flexible pipes with positive buoyancy adopt an S-shaped position;

5) subsequently disconnecting the ends of the flexible pipes with positive buoyancy in order to connect them to said floating support via a said turret; and 6) simultaneously or subsequently connecting the bottom ends of the risers with the ends of pipes resting on the sea bottom.

In another more particular aspect, the present invention provides a method of operating an oil field with the help of at least one installation of the invention in which petroleum fluids are transferred between undersea pipes resting on the sea bottom and a floating support, the installation preferably comprising a plurality of said hybrid towers, in particular three to twenty said towers connected to a common floating support.

In known manner, in order to connect together the various pipes, connector elements are used, in particular of the automatic connector type, including locking between a male portion and a complementary female portion, this locking being designed to be performed very simply at the sea bottom with the help of a remotely operated vehicle (ROV), i.e. a robot that is controlled from the surface, without requiring direct manual intervention by personnel.

BRIEF DESCRIPTION OF THE DRAWINGS

Other characteristics and advantages of the present invention appear in the light of the following detailed description given with reference to the accompanying figures, in which.

DETAILED DESCRIPTION OF THE PRESENTLY PREFERRED EMBODIMENTS

Figure 1:
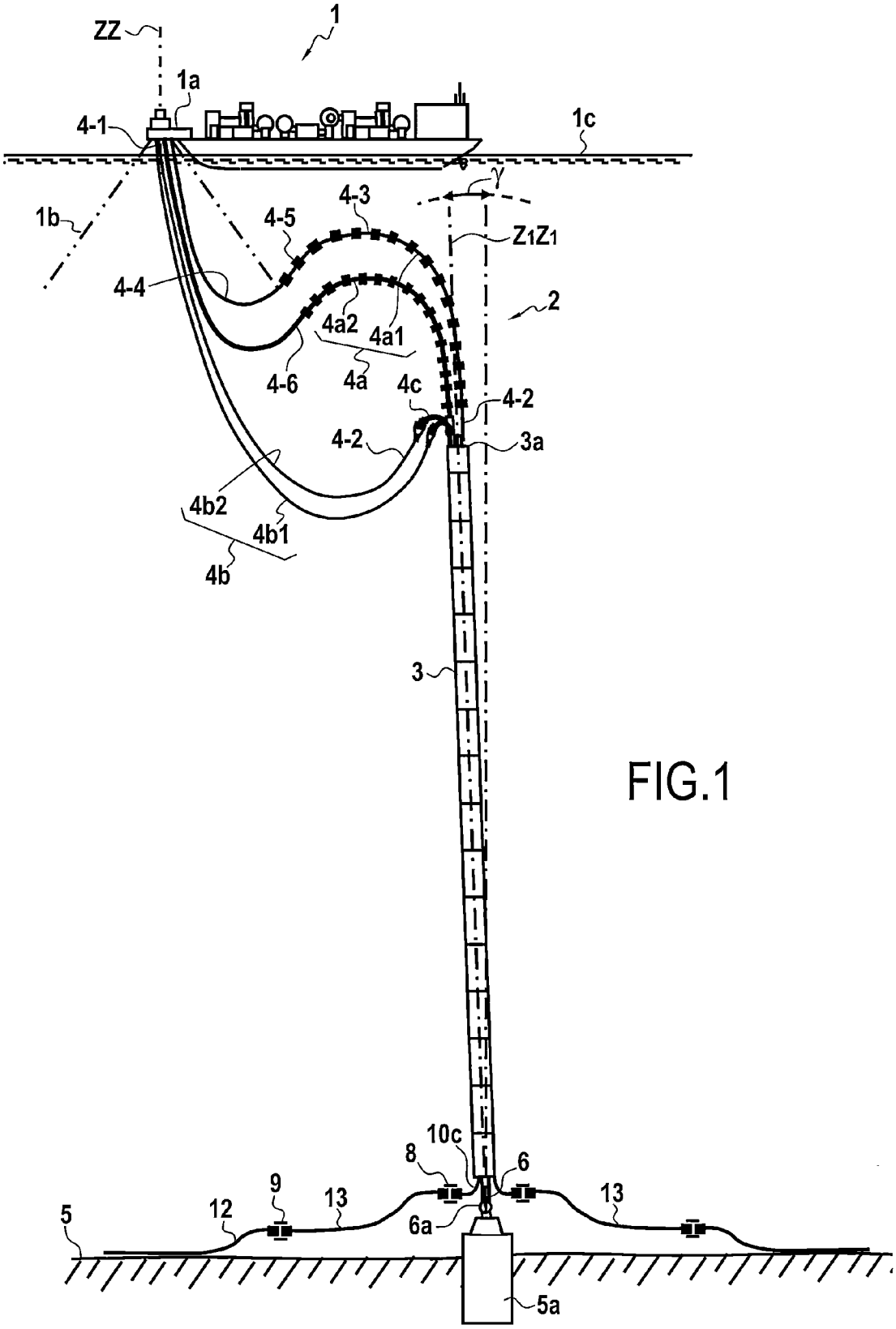
FIG. 1 is a side view of a hybrid tower type bottom-to-surface connection installation 2 of the invention between the bottom of the sea 5 and an FPSO type floating support 1 anchored on a turret 1*a*, the foot of the multi-riser tower 3 being hinged at 6*a* relative to a foundation 5*a;*

FIG. 1 is a side view of an FPSO type floating support 1 anchored on a turret 1*a* by anchor lines 1*b*, said turret being situated beyond the stem of the FPSO and being connected to a hybrid tower type bottom-to-surface connection 2 having four flexible pipes 4, 4*a*-4*b*, and a multi-riser tower 3. Said flexible pipes 4 are connected to the top of the tower 3, each flexible pipe 4 being connected to a respective one of the rigid pipes 10 of said multi-riser tower 3, as explained in greater detail in the description below of the invention.

Two first flexible pipes 4*a*, numbered 4*a*1 and 4*a*2 present floats 4 5 over a portion 4 3 of their length, thereby imparting positive buoyancy thereto and thus ensuring continuously varying curvature facing downwards or towards the bottom 5 up to the point of connection with the top end 10*a* of a substantially rectilinear rigid pipe 10 of the tower, i.e. a pipe of radius of curvature that is therefore substantially infinite, or in other words its curvature is substantially zero. The first portion 4 4 of the first flexible pipe 4*a* between the turret and the portion 4 3 does not have floats and therefore presents apparent weight in water and its overall curvature in the form of a dipping catenary presents a concave side facing upwards. The first portion 4 4 and the terminal portion 4 3 of the first flexible pipes 4 a join at a point of inflection 4 6, i.e. a point where the curvature of the pipe 4*a* changes, the terminal portion 4-3 with positive buoyancy presenting a curved shape with its convex side directed towards the surface 1*c*. Overall, the first flexible pipe thus presents an S-shaped configuration.

Two second flexible pipes 4*b*, numbered 4*b*1 and 4*b*2 of smaller diameter are connected to respective gooseneck type connections 4*c*, which are connected to the top ends of respective corresponding rigid pipes 10 of the tower 3. The curvature of the second flexible pipe 4*b* has its concave side facing upwards in a dipping catenary configuration from its point of connection 4-1 with the turret to its point of connection 4-2 with the gooseneck 4*c*.

The horizontal forces generated by the flexible pipes in the catenary configuration act on the top of the tower 3 and cause it to tilt at an angle γ relative to the vertical.

In FIG. 1, the bottom of the tower 3 is connected to a suction anchor type foundation 5*a* embedded in the sea bottom 5 via a flexible hinge 6*a* secured to the bottom end of the tension leg 6 situated on the axis $Z_1Z_1$ of the tower 3 and taking up all of the upward vertical forces created by the various buoyancy elements 11 and 21 incorporated in the tower, as explained in greater detail in the detailed description of the invention below.

Figure 2:
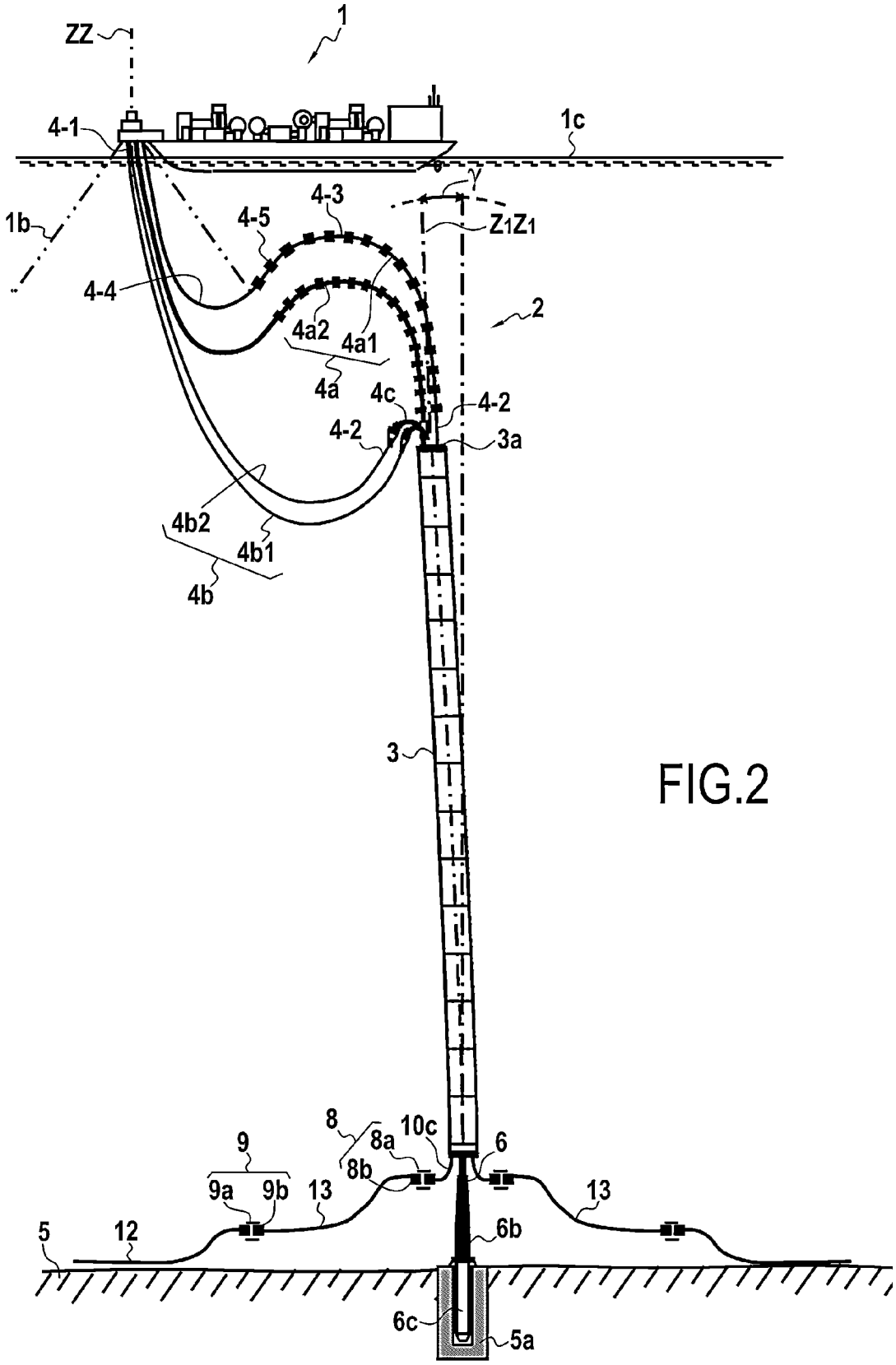
FIG. 2 shows a variant of FIG. 1 in which the foot of the tower is embedded in the foundation 5*a* via a junction and inertia-transition part 6*b;*

In FIG. 2, the bottom end of the axial tension leg 6 of the tower 3 is connected to the foundation 5*a* via a junction part of varying inertia 6*b*, with its inertia increasing going towards said foundation, the junction part 6*b* being secured to a rod 6*c* embedded in said foundation 5*a*. This causes the axial tension leg 6 of the tower 3 to be embedded in the foundation 5*a*, thereby avoiding any need to implement a flexible hinge 6*a* of the kind description with reference to FIG. 1, where such a hinge is extremely expensive. For towers used in great depths, i.e. in the range 2000 m to 2500 m, or even more, and having a large number of rigid pipes 10, the vertical forces that such junction parts 6*b* or flexible hinges 6*a* need to be able to withstand suffering any mechanical failure throughout the lifetime of such installations, i.e. 20 years or 25 years or even longer, are considerable and may reach and exceed 800 t to 1000 t, or even more. Thus, the varying-inertia junction part 6*b* is much more reliable since there is only one component and thus no relative movement between a plurality of components as happens for a flexible mechanical hinge 6*a*. In addition, such a hinge remains very difficult and much more expensive to fabricate in order to achieve the same level of reliability. Such a varying-inertia junction part 6*b* is described in detail in patents WO 2009/138609 and WO 2009/138610 in the name of the Applicant.

In FIGS. 1 and 2, said tension leg 6 and said top carrier structure 3*a* are not suspended from a float immersed in the subsurface. Thus, said tension leg 6 may be situated at a distance from the vertical axis (ZZ) of the turret that is less than the distance between said turret axis and the end of said floating support that is furthest away, i.e. within the swinging area of the vessel and without danger for the vessel.

In FIGS. 1 and 2, a junction pipe 13 with multiple curves provides the connection via connectors 8 and 9 between the bent bottom end 10*c* of the pipe 10 and a pipe 12 resting on the sea bottom and extending to the well heads, in a manner known to the person skilled in the art.

Figure 3:
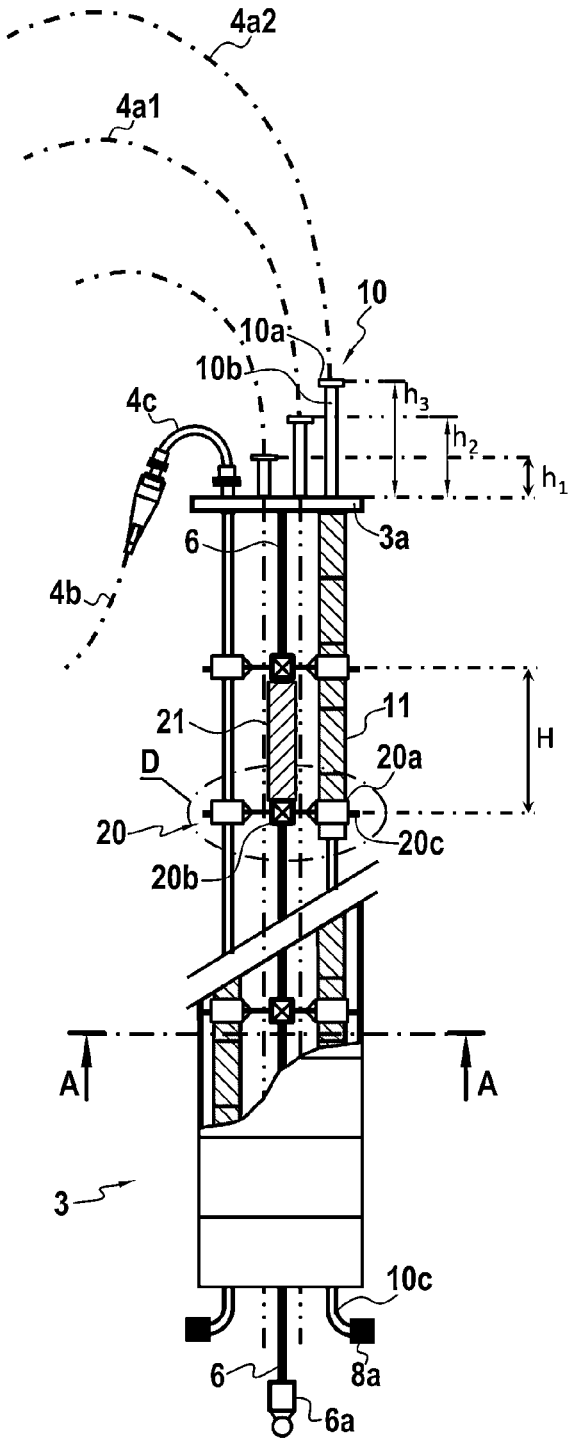
FIG. 3 is a cutaway side view of the substantially vertical portion of the tower constituted by rigid pipes or risers 10 and the tension leg 6, showing the various components making it up, namely the top ends 10*a*-10*b* of the risers 10 above the top carrier structure 3*a*, guide modules 20, second floats 11 of the risers 10, and third floats 21 of the tension leg 6.

FIG. 3 is a partially cutaway side view showing the structure of the tower 3 proper. It is constituted by a top carrier structure forming a top platform 3*a* having a plurality of rigid pipes 10 fastened thereto, the rigid pipes extending along the entire height of said tower, with each of the top ends of said pipes having a connection flange 10*a* extending over the carrier structure 3*a* so as to enable it to be connected to a respective flange at the end 4-2 of the corresponding first flexible pipe 4*a*, 4*a*1-4*a*2. In order to avoid interference between two adjacent first flexible pipes 4*a*1-4*a*2 in the connection zone with the tower and over the rest of their length, each of the flanges 10*a*, from left to right is offset upwards by respective increasing values h1, h2, h3 relative to the platform 3*a*, as shown in FIG. 3. Advantageously, the values of h1, h2, h3 depend on the type and on the number of first flexible pipes and are such that the differences h3−h2 and h2−h1 lie in the range 2 m to 10 m, and preferably in the range 3 m to 6 m.

Figure 3A:
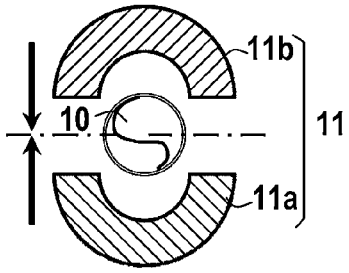
FIG. 3A is a cross-section view of one of the rigid pipes 10 showing details of how half-shells 11*a* for providing insulation and buoyancy are assembled together to form a sleeve 11.
Figure 3B:
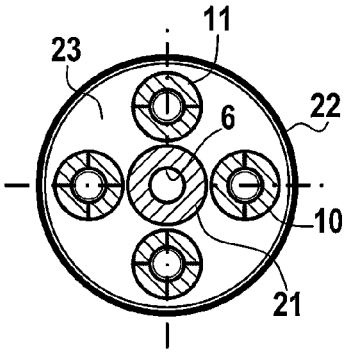
FIG. 3B is a cross-section view on plane AA of FIG. 3 showing in detail how four rigid pipes or risers 10 with insulations 11 are positioned around a central tension leg 6 providing the connection with the foundation 5*a;*

As shown in FIG. 3A, each of the rigid pipes 10 is surrounded by tubular sleeves 11, preferably made up of semi-cylindrical half-shells 11*a* that are assembled together so as to provide the pipes not only with insulation, but also with buoyancy to compensate the deadweight of the current pipe. These sleeves 11 are installed continuously from the top of the rigid pipe, from the level of the top flange 10*a* down to the foot of the tower 3 level with the termination of the pipe 10 that is fitted with the male 8*a* portion of an automatic connector. The bent bottom portion 10*c* and also the top portion 10*b* extending between the top platform 3*a* and the flange 10*a* of the rigid pipe 10 are likewise fitted with insulating and buoyancy sleeves (not shown) similar to the sleeves 11 described above.

Each of the sleeves 11 is mechanically fastened to its rigid pipe 10 in rigid manner, by means that are not shown, so that said sleeve cannot slide axially on said pipe 10. Thus, if the buoyancy of the sleeve corresponds exactly to the weight in water of the portion of pipe 10 that it covers, then each meter of pipe fitted with a sleeve presents zero weight in water. Advantageously, the linear buoyancy of the set of sleeves 11 corresponds to 102% to 115% and preferably lies in the range 103% to 106% of the deadweight of the entire pipe 10 when immersed in water and filled with water. Thus, the deadweight of the pipe 10 filled with water is compensated all along said pipe 10, and residual buoyancy corresponding respectively to 2% to 15%, and preferably 3% to 6% of the deadweight of the pipe filled with water when in water, then acts against the underface of the top platform 3*a*. This buoyancy is transmitted to the top platform 3*a* via the pipe 10 that is secured to said platform 3*a*. As a result, said pipe 10 is in compression in its top portion close to said top platform 3*a*. When the pipe 10 is filled with hydrocarbon, which generally presents specific gravity in the range 0.8 to 0.9, the force transmitted to the top platform 3*a* increases correspondingly and the portion of pipe 10 under compression stress also increases. Furthermore, the compression stress in the zone close to said top platform 3*a* also increases in proportion. Likewise, in the event of a large pocket of gas coming from the wells, the inside of the vertical pipe 10 may be filled completely with gas, in other words be empty of hydrocarbon. The pipe 10 is then completely light and the top fraction of pipe 10 under compression stress is then maximized, with the compression stress in the zones close to said top platform 3*a* also being at a maximum. Thus, 15% to 40% of the length of the rigid vertical pipe 10, when filled with gas, may be under axial compression stress, thereby running a major risk of lateral buckling. In order to avoid that unwanted phenomenon, guide modules 20 are installed at regular intervals, each constituted by a rigid structure comprising a central element 20*b* secured to the central tension leg 6 and a plurality of guide elements 20*a* guiding and holding the vertical pipes 10 of the tower 3 at a constant distance from the central tension leg 6, and thus substantially in a straight line. The guide elements 20*a* are distributed over a plane that is substantially perpendicular to the axis $Z_1Z_1$ of the tower 3 and they are arranged all around said central tension leg 6, preferably at a constant distance from said central tension leg and connected to the element 20*b* by arms or structural elements 20*c* that are preferably made of steel, the assembly thus constituting a diaphragm for guiding the pipes 10 as insulated by the sleeves 11. Said guide element 20*a* forms a tubular orifice that is preferably of circular section with an inside diameter that is slightly greater than the outside diameter of the buoyancy sleeve 11 of the corresponding rigid pipe 10. In this way, the pipe 10 as insulated by the sleeve 11 is free to slide freely over its entire height below the top platform 3*a*, under the effects of temperature, pressure, or a reduction length due to compression (pipe full—pipe empty). All of these variations in the length of the pipes 10 have repercussions at the bottom of the tower and give rise to movements that are absorbed by said multiply-curved junction pipes 13. Thus, since each of the rigid pipes 10 is suspended from the top platform 3*a*, it can lengthen or shorten individually without changing the behavior of the adjacent rigid pipes 10.

These guide modules or diaphragms 20 are arranged over the entire height of the tower 3, preferably at constant intervals H, but they could advantageously also be arranged closer to one another in the top portion so as to avoid the above-mentioned buckling phenomenon. Thus, for a tower having a height of 1600 m, the guide modules 20 are advantageously spaced apart by 5 m to 7.5 m over a height of 150 m from the top platform 3*a*, then by 10 m over the next 300 m, and finally by 15 m over the remainder of the height of said tower down to its foot.

The central tension leg 6 is itself provided with buoyancy elements or third floats 21 all along its height. In FIG. 3, for better understanding of the figure, there is shown only one buoyancy element 21 between two guide modules 20. The buoyancy of each of the elements 21 is adjusted to compensate for the deadweight in water of the tension leg 6 itself, and also for the deadweight proportion of the corresponding guide module. Thus, the buoyancy element 21 as shown in FIG. 3 compensates for the weight in water of the height H of the tension leg 6 and also for the deadweight in water of a complete guide module 20.

The second flexible pipes 4*b* are lighter in weight than the first pipes 4*a* and their weight can be taken up by the top platform 3*a*. The same applies of the gooseneck 4*c* and to various structural elements that are not shown. Nevertheless, buoyancy elements (not shown) may compensate for the deadweight of the set of second pipes 4*b* among said flexible pipes, of their respective gooseneck type devices, and of the deadweight of the top platform 3*a*, which together may amount to several tens of metric tonnes in total.

Advantageously, the second flexible pipes 4*b* are of smaller diameter and are of lighter weight in water than the first pipes 4*a* so as to avoid pointlessly increasing the additional buoyancy required at the top platform 3*a*. In addition, the first flexible pipes 4*a* that are heavier or of greater diameter possess their own buoyancy 4-5 over a portion 4-3 of their length, as explained above.

Thus, the vertical tension exerted on the foundation 5*a* corresponds substantially to the resultant of the upwardly-directed forces on the top platform 3*a*, and thus to the sum of all of the upwardly-directed vertical forces from each of the rigid pipes 10, whether they be full of water, crude oil, or gas, as mentioned above.

When all of the pipes 10 are in production, i.e. normally full, the tension on the foundation is minimized, but as soon as some of them become accidentally full of gas under pressure or at atmospheric pressure, this tension increases significantly. In the unlikely event of all of the production pipes 10 being filled with gas, the tension exerted on the foundation 5*a* would be doubled or even quadrupled, thus going for example from 100 t to 150 t in normal operation to 400 t to 800 t or even more under extreme conditions, on the basis of which regulations and oil industry operators require installations to be dimensioned. It has thus been found that a varying-inertia transition part 6*b* needs no more than additional material, generally steel or titanium, while its complexity is hardly modified. In contrast, a mechanical hinge 6*a* which is very difficult and expensive to fabricate, leads to a considerable increase in cost since it needs to be overdimensioned in order to withstand extreme forces that never actually occur in practice, but that for safety grounds are considered as constituting the maximum forces that need to be taken into account, over and above conventional safety coefficients.

Figure 4A:
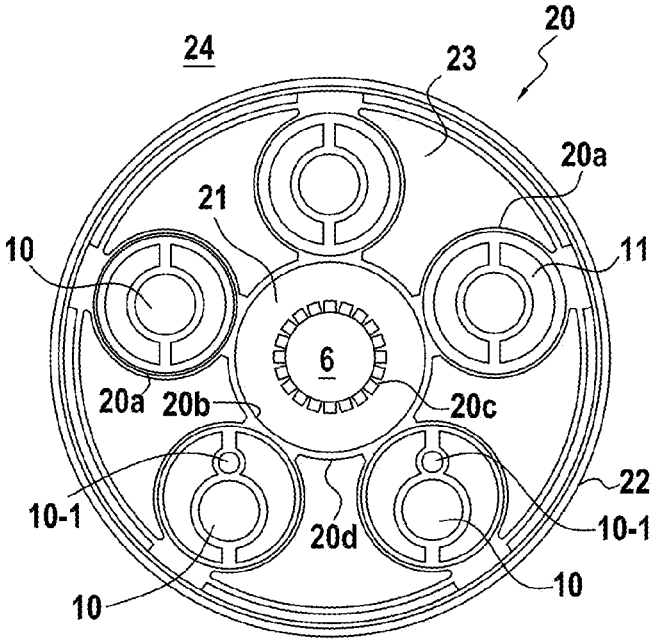
FIG. 4A is a view of a multi-riser tower in horizontal section through a guide module 20, also referred to below as a "diaphragm", acting as the centralizing element and as the element for guiding five insulated rigid pipes 10.

FIG. 4A is a section view seen from below of plane AA in FIG. 3 showing a guide module 20 and in particular:

- the positions and the connections at 20*d*, e.g. by welding, of the guide elements 20*a* around the central element 20*b* of the module 20;
- the positions of the insulating elements 11 of the pipes 10 inside the tubular orifices of the guide elements 20*a*; and
- the connection at 20*c*, e.g. by welding, between said central element 20*b* of the module 20 and the central tension leg 6.

Figure 3C:
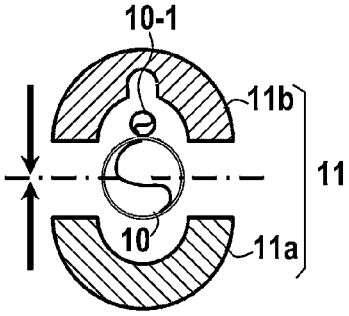
FIG. 3C is a cross-section similar to FIG. 3A in which a small diameter pipe 10-1 for injecting gas is positioned in contact with the main rigid pipe 10, all along it, the two half-shells 11*a*-11*b* forming a common insulating sleeve for the two pipes 10 and 10-1, together.
Figure 3D:
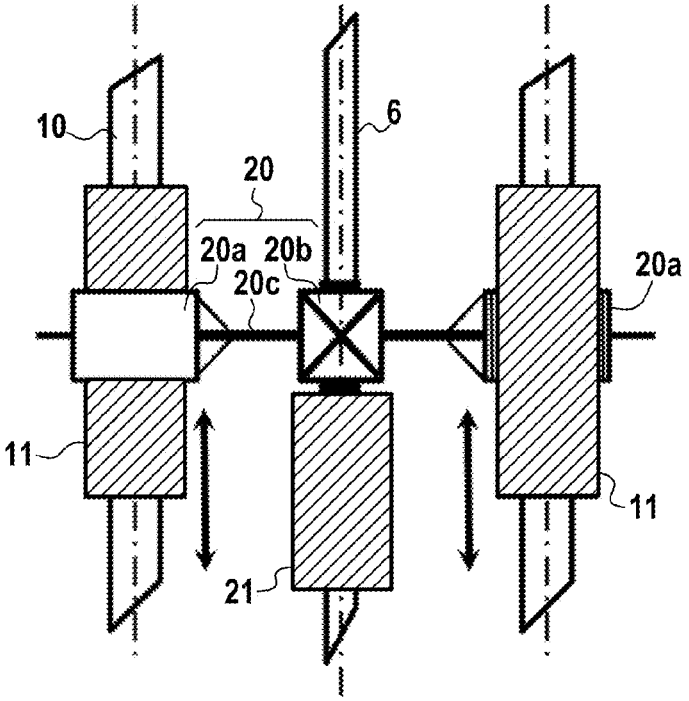
FIG. 3D is a side view of a guide module with a guide element 20*a* in vertical section showing the second float 11 suitable for sliding in the orifice formed by the guide element 20*a;*

Five pipes 10 are thus shown, comprising three single pipes as shown in FIG. 3A and two "piggyback" pipes as shown in FIG. 3C, where a small pipe 10-1 is a pipe for injecting gas into the corresponding large pipe 10, with injection mode, which is known to the person skilled in the art, being performed at the foot of the tower and serving to accelerate the speed with which crude oil rises towards the FPSO.

Figure 4B:
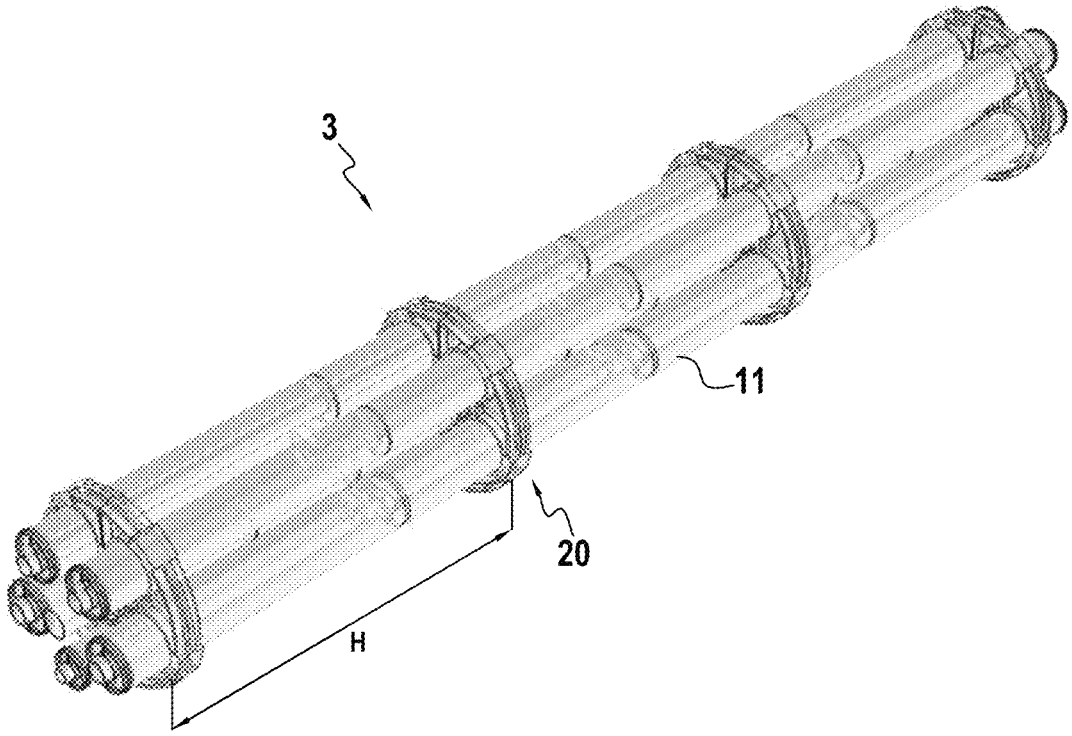
FIGS. 4B and 4C are perspective views of a portion of a multi-riser tower without its outer covering (FIG. 4B) and with its outer covering 22 (FIG. 4C)

FIG. 4B is a perspective view of a tower 3 of cross-section that corresponds to FIG. 4A and showing three guide modules 20 together with five pipes 10 fitted with their insulation and buoyancy elements or first floats 11.

Figure 4C:
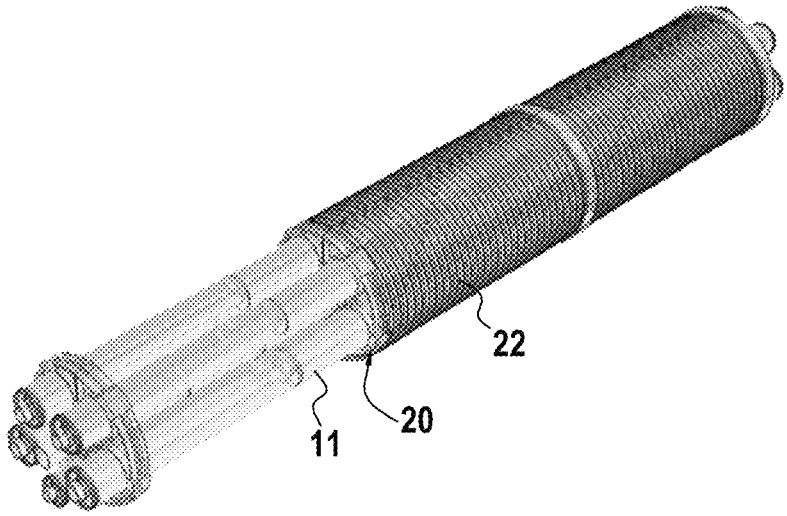

In FIG. 4C, an outer covering 22 of circular section and made of composite or plastics material, preferably of polyethylene or polypropylene, constitute a rigid hydrodynamic protective screen serving to reduce the forces exerted on the tower 3 firstly by currents, and secondly, where appropriate, by swell in the top portion of said tower. These screens 22 are advantageously fabricated as pairs of half-shells presenting lengths corresponding substantially to the distance H between two said guide modules 20. They are then assembled directly between two modules 20 and mechanically fastened thereto. Furthermore, the screens 22 confine the inside volume 23 extending between two said guide modules 20 and said outer covering 22, thereby limiting transfer to heat with the surroundings 24 and reducing heat losses through the insulating sleeves 11 of the rigid pipes 10. By confining the inside 23 in this way from the outside 24, the temperature $t_1$ in the inside 23 is always higher than the temperature $t_0$ on the outside 24. This results in a smaller temperature difference between the pipes 10 and the inside 23 and thus to significantly reduced heat losses.

Figure 6:
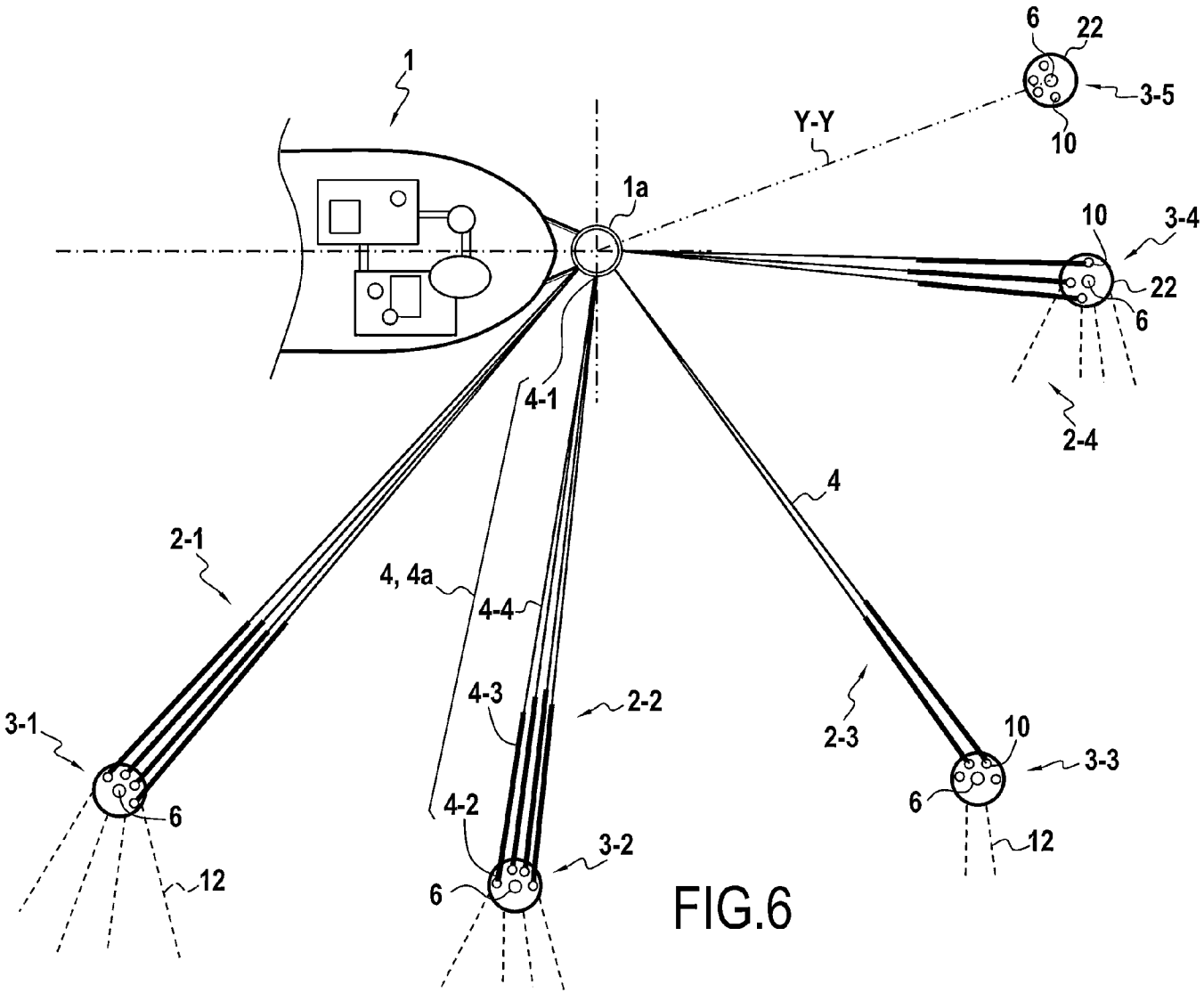
FIG. 6 is a plan view of an FPSO anchored on a turret and connected to four towers 2, numbered 2-1 to 2-4, together with a fifth tower 2-5 that has been pre-installed but that is not yet connected to the FPSO by flexible pipes 4.

FIG. 6 is a plan view of an FPSO 1 anchored on a turret 1*a* and connected to four hybrid towers 3-1, 3-2, 3-3, 3-4 by respective pluralities of flexible pipes 4*a*. A fifth multi-riser tower 3 5 has been pre-installed but will not be used until later on when the oil field is extended. For the multi-riser towers 3 1 and 3 2, the four rigid pipes 10 are connected firstly to the FPSO 1 by four first flexible pipes 4*a* and secondly, at the foot of the tower, to four rigid pipes 12 resting on the sea bottom. For the tower 3 3, only two rigid pipes 10 are connected to the FPSO by two flexible pipes 4*a* and to two rigid pipes 12 resting on the bottom, with two pipes 10 waiting to be connected to well heads and to the FPSO. Likewise, the tower 3 4 has only three rigid pipes 10 connected to the FPSO by three flexible pipes 4*a* and also to rigid pipes 12 resting on the bottom.

Such a fan configuration enables at least some of the multi-riser towers 3 to be installed in the swinging area of the floating support 1, thereby making it possible to increase the number of hybrid tower type bottom-to-surface connections 2 and to reduce the lengths of the flexible pipes 4.

In FIGS. 1 to 6, a bottom-to-surface connection installation between a plurality of undersea pipes (12) resting on the sea bottom (5) and a floating support (1) on the surface (1*c*) and anchored (1*b*) to the sea bottom comprises:

a said floating support including a turret (1*a*) having a cavity within a structure offset in front of the floating support or incorporated in or under the hull of the floating support, said cavity preferably passing through the full height of the hull of the floating support; and at least one hybrid type tower (2), and in particular three to twenty towers, each comprising:

a) a multi-riser tower (3) comprising:

a.1) a vertical tension leg (6) secured at its top end to a top carrier structure (3*a*), said tension leg being fastened at its bottom end to a base resting on the sea bottom or to an anchor, preferably of the suction and anchor type (5*a*) embedded in the sea bottom, said tension leg (6) and said top carrier structure (3*a*) not being suspended from a float immersed in the subsurface, and said tension leg being situated at a distance from the vertical axis (ZZ) of the turret that is less than the distance between said axis of the turret and the furthest-away end of said floating support;

a.2) a plurality of vertical rigid pipes (10) referred to as "risers", in particular two to eight rigid pipes, the top end (10*a*) of each riser extending above said carrier structure (3*a*), being secured thereto, the bottom end (10*b*) of each riser being connected to or being suitable for being connected to an undersea pipe (12) resting on the sea bottom, and said risers being fitted with peripheral coaxial second floats (11) surrounding said risers and secured to said risers, said coaxial second floats being distributed, preferably continuously, at least over a top portion comprising at least 50% of the length of said risers beneath and from said top carrier structure, preferably over the total length of said risers, said coaxial second floats associated with a riser compensating at least for the deadweight of said riser when full of water, and in any event the set of said coaxial second floats compensating at least for the total weight of said risers full of water;

a.3) a plurality of guide modules (20) for guiding said risers, said guide modules being suitable for holding said risers arranged around said tension leg at a substantially constant distance, the risers preferably being regularly and symmetrically distributed around said tension leg, said guide modules (20) being secured to said tension leg and being suitable for sliding along said second float (11) of said risers, said guide modules being spaced apart and distributed over at least a said top portion of at least 50% of the length of said tension leg beneath and starting from said top carrier structure, and preferably over the total length of said tension leg; and b) a plurality of flexible pipes (4*a*-4*b*, 4*a*1-4*a*2, 4*b*1-4*b*2) extending from said turret to which their top ends (4-1) are connected, to the top ends (10*a*) of respective ones of a plurality of rigid pipes (10) to which the other ends (4-2) of said flexible pipes are connected, including at least two flexible pipes, referred to below as "first" flexible pipes, each having a terminal portion (4-3) of the flexible pipe adjacent to its junction with the top end of said riser that is fitted with floats (4-5) referred to as "first" floats imparting positive buoyancy thereto, and at least the top portion of said vertical riser is fitted with floats (11) referred to as "second" floats imparting positive buoyancy thereto, such that the positive buoyancies of said terminal portion (4-3) of the first flexible pipe and said top portion of said vertical riser (9) enable said risers to be tensioned in a substantially vertical position and enable the end (4-2) of said terminal portion (4-3) with positive buoyancy of said first flexible pipe to be in alignment with or in continuity of curvature with the top portion of said vertical riser where they are connected together, said terminal portion (4-3) of first flexible pipe (4) extending over a fraction of only 30% to 60% of the total length of the first flexible pipe such that said first flexible pipe (4*a*) presents an S-shaped configuration, with a first portion (4-4) of first flexible pipe beside said floating support (1) presenting concave curvature in the form of a dipping catenary and said remaining terminal portion (4-3) of said first flexible pipe (4*a*) presenting convex curvature in the form of an upside-down catenary as a result of its positive buoyancy, the at least two said first flexible pipes with positive buoyancy (4*a*, 4*a*1-4*a*2) having their ends (4-2) fastened respectively to top ends (10*a*) of two said risers (10), the two top ends (10*a*) of the two risers projecting above said top carrier structure (3*a*) at different heights (h1, h2, h3) such that said first flexible pipes are positioned at different heights relative to one another (4*a*1, 4*a*2).

Figure 5A:
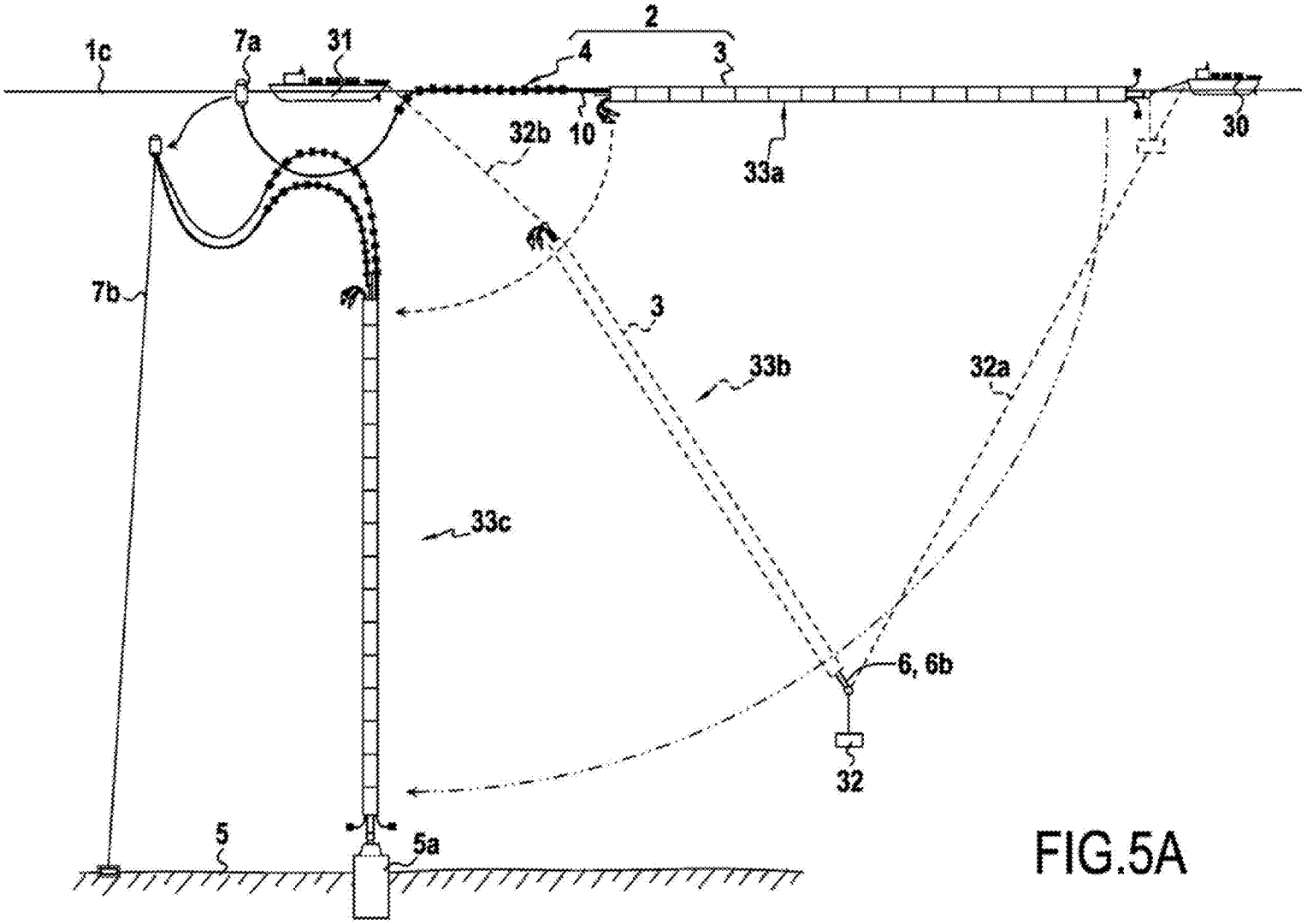
FIG. 5A is a side view showing details of towing to site, up-ending, and installing a tower with flexible pipes.

FIG. 5A is a side view of the process for installing the tower on site together with the flexible pipes, the process comprising:

prefabricating the tower 3 on land, the pipes 10 being filled either with water or with air, and then launching the tower 3 at sea;

towing the floating tower to its site with at least one lead vessel 31, the pipes 10 that are partially or completely filled with air giving the tower a large amount of positive buoyancy;

on site, with the tower in the horizontal position 33*a*, filling some or all of the pipes 10 with sea water and optionally installing a deadman 32 to the bottom end of the tower. A first cable 32*a* connects said bottom end of the tower to a winch situated on the vessel 30, and a second cable 32*b* connects the same end to a winch situated on a second vessel 31;

up-ending 33*b* the tower under control by controlling the lengths of the cables 32*a* and 32*b*, and then securing the tower to its foundation 5*a;* after disconnecting the cables, the tower as described above together with its pipes full of sea water and with all of its buoyancy elements presents positive buoyancy and naturally remains in a vertical position 33*c*; and where appropriate (FIG. 5B) then connecting the ends 4-1 of the flexible pipes to respective buoys 7*a* connected to deadman moorings 7*c* by cables 7*b*, ready for future use.

Figure 5B:
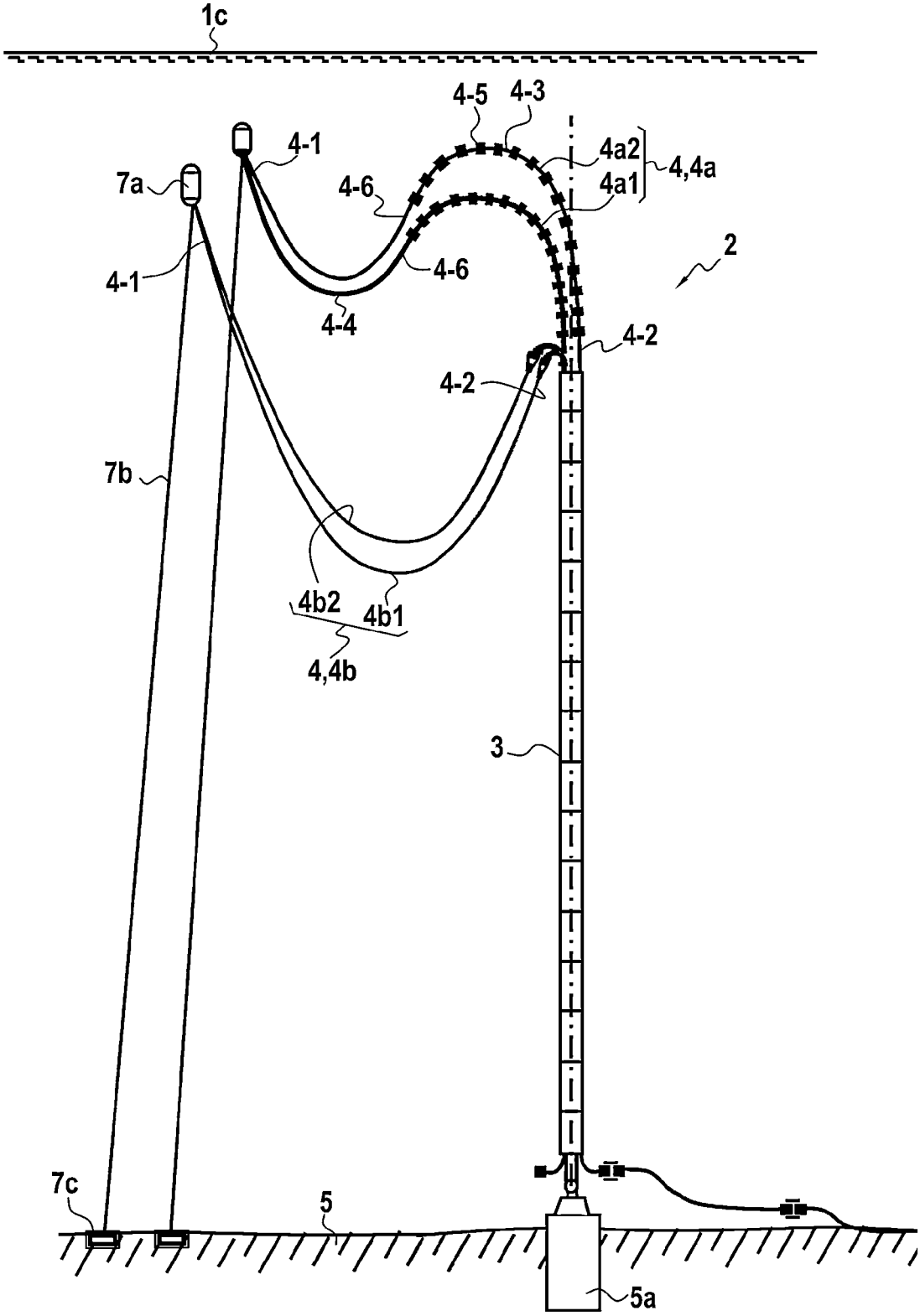
FIG. 5B is a side view of a bottom-to-surface connection of the invention that is partially pre-installed on site before putting an FPSO into place, the flexible pipes 4 being held in the subsurface by means of floats 7*a* and cables 7*b* connected to deadman moorings 7*c*.

FIG. 5B is a side view showing the pre-installed tower 2 prior to putting the FPSO in place, the various flexible pipes being connected in provisional manner to floats 7*a* that are connected by cables 7*b* to deadman moorings 7*c* resting on the sea bottom 5.

The invention claimed is:

1. A bottom-to-surface connection installation between a plurality of undersea pipes resting on the sea bottom and a floating support at the surface and anchored to the bottom of the sea, the installation comprising:

said floating support including a turret; and at least one hybrid type tower comprising:

a) a multi-riser tower comprising:

a.1) a vertical tension leg secured at its top end to a top carrier structure, said tension leg being fastened at its bottom end to a base resting on the sea bottom or to an anchor, pressed into the sea bottom;

a.2) a plurality of vertical rigid pipes referred to as "risers", the top end of each riser being secured to said carrier structure, the bottom end of each said riser being connected to or being suitable for being connected to one of the plurality of undersea pipes resting on the sea bottom; and a.3) a plurality of guide modules suitable for maintaining said risers arranged around said tension leg at a distance that is substantially constant; and b) a plurality of flexible pipes extending from said turret to the respective top ends of the plurality of rigid pipes, with at least one flexible pipe, referred to below as a "first" flexible pipe, having a terminal portion of the flexible pipe adjacent to its junction with the top end of said riser that is fitted with floats referred to as "first" floats imparting positive buoyancy thereto, said terminal portion of the first flexible pipe extending over a fraction only of the total length of the first flexible pipe such that the first flexible pipe presents an S-shaped configuration, with a first portion of the first flexible pipe beside said floating support presenting concave curvature in the form of a dipping catenary, and said remaining terminal portion of said first flexible pipe presenting convex curvature in the form of an upside-down catenary because of its positive buoyancy and at least a top portion of said vertical riser is fitted with floats referred to as "second" floats imparting positive buoyancy thereto, such that the positive buoyancies of said terminal portion of the first flexible pipe and of the top portion of said vertical riser serve to enable said risers to be tensioned in a substantially vertical position and enable the end of said first terminal portion with positive buoyancy of said first flexible pipe to be in alignment with or in continuity of curvature with the top portion of said vertical riser where they are connected together;

wherein at least one said hybrid tower comprises:

at least two said first flexible pipes with positive buoyancy having their ends fastened respectively to two top ends of two said risers, the two top ends of the two risers extending above said top carrier structure at different heights in such a manner that said first flexible pipes are positioned at different heights relative to one another;

said risers fitted with peripheral coaxial second floats surrounding said risers and secured to said risers, said coaxial second floats being distributed over at least a top portion of at least 25% of the length of said risers beneath and starting from said top carrier structure, said coaxial second floats together compensating at least the total weight of said risers;

said guide modules secured to said tension leg and suitable for sliding along said second float of said risers, said guide modules being spaced apart and distributed, over at least a top portion of at least 25% of the length of said tension leg beneath and starting from said top carrier structure; and said tension leg and said top carrier structure not being suspended to a float immersed in the subsurface, and said tension leg being situated at a distance from the vertical axis (ZZ) of the turret that is less than the distance of the furthest-away end of said floating support from said axis of the turret.

2. The installation according to claim 1, wherein the minimum height offset of the top ends of said risers to said first flexible pipes are fastened, and thus the minimum distance in height between two of said first flexible pipes arranged at different heights is at least 3 m.

3. The installation according to claim 1, wherein said tower has two to seven rigid pipes and two to five said first flexible pipes (4*a*).

4. The installation according to claim 1, comprising second flexible pipes of smaller diameter or smaller linear weight than said first flexible pipes, said second flexible pipes not having buoyancy elements and being connected to the top ends of said risers via connection devices, said second flexible pipes being situated beneath said first flexible pipes.

5. The installation according to claim 1, wherein said tension leg is fastened at its bottom end to said base or anchor via an inertia-transition junction part of inertia varying in such a manner that its inertia increases progressively from its top end to the bottom end of said junction part serving to embed the bottom end of said tension leg in said base or anchor.

6. The installation according to claim 1, comprising third floats secured to said tension leg at least in the spaces between said guide modules, said third floats providing positive buoyancy compensating at least for the weight of said tension leg.

7. The installation according to claim 1, wherein said guide modules constitute a plurality of independent rigid structures that are spaced apart by at least 5 m along at least the top portion of said tension leg, each said rigid structure having a plurality of riser-guiding tubular elements defining tubular orifices in which said risers, together with their second floats, can slide, and a central element connected to the tension leg and defining a central orifice through which said tension leg passes and is secured thereto.

8. The installation according to claim 1, wherein said guide modules are spaced apart by a distance in the range 2 m to 20 m, and are at least twenty in number.

9. The installation according to claim 1, wherein said first floats together provide accumulated buoyancy representing a traction force of magnitude greater than the total weight of said risers.

10. The installation according to claim 1, wherein said coaxial second floats are distributed continuously over the entire length of said risers beneath and starting from said top carrier structure, and said guide modules are distributed over the entire length of said tension leg beneath and starting from said top carrier structure.

11. The installation according to claim 1, wherein said first and second floats are in the form of tubular sleeves, made of a material that withstands undersea hydrostatic pressure, and at least said second floats are made of a material that also presents thermal insulation properties.

12. The installation according to claim 1, wherein said positive buoyancy of said first floats and of said first flexible pipes is distributed regularly and uniformly over the entire length of said terminal portion of said first flexible pipe, and the buoyancy of said second floats that are distributed over at least said top portion of the rigid pipes provides a resulting vertical thrust of 50 kg/m to 150 kg/m over the entire length of said rigid pipes, and/or said first floats of the first flexible pipes provide positive buoyancy over a length corresponding to 30% to 60% of the total length of said first flexible pipes.

13. The installation according to claim 1, wherein said tower includes a cylindrical outer covering of circular horizontal section made of a plastics or composite material forming a hydrodynamic rigid protective screen surrounding all of said rigid pipes and at least over a top portion of the tower.

14. The installation according to claim 1, having a plurality of said multi-riser hybrid towers with their flexible pipes connected or suitable for being connected to a common turret but extending in directions (YY') that are angularly offset so that said towers are arranged in a fan around said turret at distances from said turret that are identical or different.

15. A method of towing a multi-riser tower at sea and of putting an installation according to claim 1 into place, the method comprises the following successive steps:

1) prefabricating on land said tower connected at its head to said flexible pipes with positive buoyancy and having their free ends connected to respective fourth floats;
2) towing said tower at sea in a horizontal position by a laying vessel, said tower floating on the surface because of its said second floats;
3) installing a deadman to the bottom end of said tower;
4) upsetting said tower with its bottom end connected to said base and said fourth floats connected to the free ends of said flexible pipes with positive buoyancy being immersed in the subsurface and offset laterally from the axis Z1Z1 of said tower in such a manner that said flexible pipes with positive buoyancy adopt an S-shaped position;
5) subsequently disconnecting the ends of the first flexible pipes with positive buoyancy in order to connect them to said floating support via said turret; and
6) simultaneously or subsequently connecting the bottom ends of the risers with the ends of pipes resting on the sea bottom.

* * * * *